US006669477B2

(12) United States Patent
Hulet

(10) Patent No.: US 6,669,477 B2
(45) Date of Patent: Dec. 30, 2003

(54) SYSTEM AND METHOD FOR SCORING SUPERSONIC AERIAL PROJECTILES

(75) Inventor: Brian Lee Hulet, Riverside, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 100 days.

(21) Appl. No.: 09/838,225

(22) Filed: Apr. 20, 2001

(65) Prior Publication Data

US 2003/0008265 A1 Jan. 9, 2003

(51) Int. Cl.[7] ..... G09B 19/00

(52) U.S. Cl. ..... 434/14; 434/19; 273/372; 73/167; 367/127

(58) Field of Search ..... 434/11, 12, 14–17, 434/19, 23, 27, 365; 273/371, 372; 73/167; 367/108, 124, 127, 906

(56) References Cited

U.S. PATENT DOCUMENTS

| | | | | |
|---|---|---|---|---|
| 3,778,059 A | * | 12/1973 | Rohrbaugh et al. | 273/372 |
| 4,351,026 A | * | 9/1982 | Phillips | 273/372 |
| 4,813,877 A | | 3/1989 | Sanctuary et al. | |
| 5,025,424 A | * | 6/1991 | Rohrbaugh | 367/127 |
| 5,349,853 A | * | 9/1994 | Oehler | 73/167 |
| 5,781,505 A | * | 7/1998 | Rowland | 367/127 |
| 5,944,317 A | * | 8/1999 | Rohrbaugh | 273/372 |
| 6,178,141 B1 | * | 1/2001 | Duckworth et al. | 367/127 |

OTHER PUBLICATIONS

Brian Lee Hulet, "A Time Difference of Shock Wave Arrival Approach for Determining Strafing Parameters in Three Dimensions", published Apr. 21, 2000, CSUF, Fullerton, CA, p. 1–132.

"IRSSS System Manual—MCAS Yuma Cactus West Range", Draft published Oct. 5, 2000, Corona, CA.

Cartwright Electronics Inc., "Executive Summary CEI–2728 Area Weapons Scoring System", Mar. 19, 1990, Fullerton, CA.

Arcata Associates Inc. "Arcata/ADI Air–to–Ground Scoring System Test Report", May 30, 1995, Las Vegas, NV.

"Sniper Locator Finds Shooter Quickly", National Defense Magazine, Nov. 1996, p. 45.

"Building a Better Bullet", T.M. McAuliffe, Air Force Magazine, Jul. 1993, editorial comments.

"Acoustic Detection Traces Bullet, Shell Trajectories", Signal Magazine, Nov. 1994, pp. 59–61.

YPG/Oehler Research, "Field Acoustic Target for Yuma Proving Ground", Feb. 1998, p. 1–6.

Air Target Sweden AB, "Miss Distance Calculator MDC–80," Jan. 1986 Stockholm, Sweden.

EON Instrumentation, Inc., "Operational and Maintenance Manual for the Remote Strafe Scoring System Model SSS–101," Nov. 28, 1989, Van Nuys, California.

Oehler Research, Inc., "Enhanced Acoustic Scoring System—Informal Test Report", Jan. 11, 1995, Austin, TX, p. 1–20.

* cited by examiner

*Primary Examiner*—Joe H. Cheng
(74) *Attorney, Agent, or Firm*—Crane L. Lopes, Esq.

(57) ABSTRACT

A time-difference process and apparatus for scoring supersonic aerial projectiles, such as military aircraft air-to-ground strafing projectiles fired at a strafe target, by detecting and measuring the acoustic shock waves propagated by the projectiles. The process and apparatus uses an array of at least six dynamic transducers to independently sample each projectile shock wave and transmit sampled signals to at least one all-purpose digital computer. The time-differences of arrival of the shock waves at each transducer are processed by an iterative algorithm implemented by the computer. The algorithm calculates projectile impact point, projectile velocity and other useful scoring data. The scoring data are used to quantitatively score the number of hits or misses by the strafing projectiles on the strafe target. Scoring data and other projectile data are selectably indicated to the operator by remote display and printout.

18 Claims, 9 Drawing Sheets

| ITERATIONS OF THE SCORING ALGORITHM PROCESS | PROJECTILE VELOCITY ($V_P$) | MACH ANGLE ($\Theta$) | LATERAL VELOCITY ($V_L$) | FRONT SCORING PLANE IMPACT POINT ($X_{front}$, $Y_{front}$) | BACK SCORING PLANE IMPACT POINT ($X_{tgt}$, $Y_{tgt}$) | PROJECTILE DIVE ANGLE ($\varphi$) | PROJECTILE HEADING ERROR ($\Theta$) |
|---|---|---|---|---|---|---|---|
| STARTING VALUES | 2633.19 fps | 25.77° | | | | | |
| 1 | 2552.15 (Δ=−81.03) | 26.65° (Δ=0.88) | 1271.31 fps | (−2.33, 0.89) feet | (−2.28, 0.82) feet | 0.85° | 0.62° |
| 2 | 2539.59 (Δ=−12.57) | 26.80° (Δ=0.14) | 1280.98 (Δ=9.67) | (−2.33, 0.85) (Δ=0.01, −0.05) | (−2.26, 0.77) (Δ=0.02, −0.05) | 0.87° (Δ=0.03) | 0.78° (Δ=0.16) |
| 3 | 2536.05 (Δ=−3.54) | 26.84° (Δ=0.04) | 1282.59 (Δ=1.60) | (−2.32, 0.85) (Δ=0.00, −0.00) | (−2.25, 0.77) (Δ=0.01, 0.00) | 0.88° (Δ=0.00) | 0.82° (Δ=0.04) |
| 4 | 2535.15 (Δ=−0.89) | 26.85° (Δ=0.01) | 1283.04 (Δ=0.46) | (−2.32, 0.85) (Δ=0.00, 0.00) | (−2.25, 0.77) (Δ=0.00, 0.00) | 0.88° (Δ=0.00) | 0.83° (Δ=0.01) |
| 5 | 2534.91 (Δ=−0.24) | 26.85° (Δ=0.00) | 1283.16 (Δ=0.12) | (−2.32, 0.85) (Δ=0.00, 0.00) | (−2.25, 0.77) (Δ=0.00, 0.00) | 0.88° (Δ=0.00) | 0.83° (Δ=0.00) |
| 6 | 2534.85 (Δ=−0.06) | 26.85° (Δ=0.00) | 1283.19 (Δ=0.03) | (−2.32, 0.85) (Δ=0.00, 0.00) | (−2.25, 0.77) (Δ=0.00, 0.00) | 0.88° (Δ=0.00) | 0.84° (Δ=0.00) |
| 7 | 2534.84 (Δ=−0.02) | 26.85° (Δ=0.00) | 1283.20 (Δ=0.008) | (−2.32, 0.85) (Δ=0.00, 0.00) | (−2.25, 0.77) (Δ=0.00, 0.00) | 0.88° (Δ=0.00) | 0.84° (Δ=0.00) |
| 8 | 2534.83 (Δ=−0.004) | 26.85° (Δ=0.00) | 1283.20 (Δ=0.00) | (−2.32, 0.85) (Δ=0.00, 0.00) | (−2.25, 0.77) (Δ=0.00, 0.00) | 0.88° (Δ=0.00) | 0.84° (Δ=0.00) |

FIG.7

SYSTEM AND METHOD FOR SCORING SUPERSONIC AERIAL PROJECTILES

STATEMENT REGARDING FEDERALLY SPONSORED RESEARCH OR DEVELOPMENT

The inventor is a full-time employee of the United States Government. The invention claimed and disclosed herein was first conceived and reduced to practice by the inventor within the scope of his employment by the United States Government.

CROSS REFERENCE TO RELATED APPLICATIONS

Not applicable.

REFERENCE TO A MICROFICHE APPENDIX

Not applicable.

BACKGROUND OF THE INVENTION

This invention relates generally to a computer-implemented process and apparatus for scoring supersonic aerial projectiles, and more particularly to a time-difference process and apparatus for measuring the acoustic shock waves propagated by supersonic aerial projectiles to calculate the impact points of the projectiles on a strafe target. Also determined are projectile dive angle, projectile approach heading, projectile velocity and other useful scoring data such as the number and rate of projectiles fired, the impact pattern of the projectiles, projectile caliber, and estimated strafing distance of the strafe aircraft.

This invention is directed to a time-difference process and apparatus for scoring supersonic aerial (strafe) projectiles fired at a strafe target. The process and apparatus scores each projectile by measuring, detecting and calculating the differences of the time of arrival of the acoustic shock wave propagated by the projectile at an array of transducers disposed nearby the strafe target.

The process of past scoring systems has been to sample acoustic shock waves of supersonic aerial projectiles by use of a single or pairs of acoustic transducers. These transducer (s) produce an electrical signal whose amplitude is a function of the projectile distance from the transducer and the projectile size and speed. This signal is sent to a computer-implemented scoring unit where it is scaled using fixed projectile caliber and signal threshold parameters. The scaled signal is then compared to a preset threshold level. If the signal is greater than the threshold the scoring unit assumes that the projectile passed through the strafe target and a score (e.g., a "hit") is registered. If the signal is lower than the threshold level, no score (e.g., a "miss" is registered.

The accuracies of the past scoring processes are dependent on the amplitude of the signal generated by the transducer. Any factor that adversely affects this amplitude of measuring acoustic shock waves produces inaccurate strafing scores. For instance, the use of fixed projectile caliber and signal threshold parameters produces scoring errors because projectiles have varying muzzle velocity and ballistic parameters based upon the manufacturer type and production date of the projectiles. Moreover, since commercial transducers do not have identical frequency responses, transducers matched at one frequency or projectile caliber will not match at different calibers. Transducers also degrade due to weathering and must have regular calibration performed to insure accuracy. Such calibration is typically time-consuming and expensive.

Past scoring processes do not adequately account for the adverse affect on scoring accuracy caused by the speed of the strafing aircraft or platform firing the supersonic aerial projectiles. The speed of a strafing aircraft affects the velocity of the projectile at the target, which in turn affects the amplitude of the signal produced by the transducer. Aircraft strafing at high speeds will produce greater scores than would be received at slower speeds due to the increased energy of the shock wave at the target location. Past scoring processes do not differentiate between aerial (strafe) projectiles fired from static or slow-moving platforms and projectiles fired from fast-moving platforms such as jet aircraft, even though this has a significant affect on scoring accuracy.

Moreover, in past scoring processes the firing range of a strafing aircraft must be known to accurately set the fixed projectile-caliber parameter. In field use, however, strafing aircraft firing ranges vary widely between different aircraft, different pilots of the same aircraft, and even different strafing passes of the same pilot. Scoring inaccuracies results because aircraft strafing at close range receive greater scores than would be received at farther ranges due to the increased energy of the acoustic shock wave at the strafe target.

Past scoring processes also do not adequately account for the affect of ambient weather conditions on the flight paths of the aerial projectiles and upon the acoustic shock waves propagated by the projectiles. For example, the acoustic transducers used in some prior scoring apparatus use a thermistor in their circuitry that is intended to, but does not adequately compensate for, the changes in the transducer electrical output signal caused by varying ambient atmospheric temperatures. Varying ambient atmospheric temperature, wind velocities and barometric pressures significantly affect the energy of the shock wave and flight characteristics of the aerial projectiles. These weather conditions can in turn have an adverse affect on scoring accuracy because the transducer amplitude produced can vary under identical strafing parameters. The degree to which weather conditions adversely affect system accuracy is unknown in the past scoring processes and no calculation to compensate for weather affects is used.

Past scoring processes do not indicate to an operator what region of the strafe target the aerial projectiles impacted, in what order they arrived at the strafe target for pattern analysis, or which direction the off-target projectiles went. Moreover, using past processes it is very difficult for the pilot of the strafe aircraft to accurately assess aerial projectile scoring patterns due to the typically-extreme firing distances involved and the necessity for strafing aircraft bank away from the target after firing. Spotting planes and video-based surveillance systems are sometimes used to spot such scoring patterns, but not to any degree of useful accuracy. Since the impact pattern of the aerial projectiles cannot be accurately determined using the past scoring processes, analysis of aircraft pilot technique, strafe projectiles and strafe-gun system performance, and weather (notably wind velocity) affects are not possible.

Past scoring processes are inaccurate because they use a scoring area defined by the polar detection pattern of the transducer rather than the strafe target itself. In past scoring processes, the scoring area is semi-elliptical or can be made semi-circular with the addition of a transducer "cap." This non-tactical shape is essentially defined by the polar pattern of the transducer's microphone and cannot be changed. The scoring area position is fixed by the location of the transducer and cannot be offset from it. Since the physical range target is often offset from the transducer, this offset can produce scoring errors because the strafe target can be impacted without the scoring process indicating any corresponding score.

Past scoring processes also lack printout or storage capabilities for scoring archival purposes and trend analysis. Finally, aerial projectile parameters such as the projectile dive angle, strafe aircraft firing range, and the heading angle cannot be determined by the past scoring processes.

Information relevant to attempts to address these problems can be found in:

a. U.S. Pat. No. 4,813,877 to Sanctuary, et al.

Further relevant attempts to address these problems can be found in the following printed publications:

b. EON Instrumentation, Inc., Operational and Maintenance Manual for the Remote Strafe Scoring System Model SSS-101 (1989);
c. YPG/Oehler Research, Field Acoustic Target for Yuma Proving Ground (1998);
d. Air Target Sweden AB, Miss Detection Calculator MDC-80 (1986);
e. Acoustic Detection Traces Bullet, Shell Trajectories, Signal Magazine (November 1994);
f. Building a Better Bullet, Air Force Magazine (July 1993);
g. Sniper Locator Finds Shooter Quickly, National Defense Magazine (November 1996);
h. Arcata Associates, Inc., ARCATA/ADI Air-to-Ground Scoring System—System Test Report (1995);
i. Oehler Research, Inc., Enhanced Acoustic Scoring System—Informal Report (1995); and
j. Cartwright Electronics, Executive Summary CEI-2728 Area Weapons Scoring System (1990).

Each one of these references, however, suffers from one or more of the following disadvantages:

a. U.S. Pat. No. 4,813,877 discloses a strafe scoring system that uses the aforementioned amplitude scoring process of scoring the impact points of supersonic aerial projectiles upon a strafe target. The system further requires the operator to manually input the caliber of the aerial projectile and weather information to enable the disclosed amplitude scoring process.
b. EON Instrumentation, Inc., Operational and Maintenance Manual for the Remote Strafe Scoring System Model SSS-101 (1989), discusses a system that uses a single transducer to sample supersonic projectile acoustic shock waves using the aforementioned amplitude scoring process. The EON system calculates hits or misses on a strafe target using fixed projectile caliber and signal threshold parameters and does not take into account the affect of local weather conditions on the flight paths of the aerial projectiles or their acoustic shock waves.
c. YPG/Oehler Research, Field Acoustic Target for Yuma Proving Ground (1998), discusses improvements to an existing scoring system that includes requiring the operator to manually input the caliber of the aerial projectile and weather information to enable the disclosed amplitude scoring process.
d. Air Target Sweden AB, Miss Detection Calculator MDC-80 (1986), discusses a system that calculates the time of arrival of the acoustic shock wave of an aerial projectile over two pairs of transducers sequentially interposed between the firing aircraft and a strafe target. The system estimates target impact points based on the trajectory of each projectile before as well as after passing over each set of transducers. The system does not does not take into account the speed or range of the firing aircraft or the affect of local weather conditions on the flight paths of the aerial projectiles or their acoustic shock waves.
e. Acoustic Detection Traces Bullet, Shell Trajectories, Signal Magazine (November 1994), discusses a sniper-location system that utilizes a portable suite of three piezoid crystal sensors to discern a projectile's shock wave and extrapolate its path back to the originating weapon. The system calculates the approximate azimuth of the trajectory of each projectile passing directly over the sensors using an amplitude process, but does not indicate any scoring data or perform any scoring trend or archival functions.
f. Building a Better Bullet, Air Force Magazine (July 1993), discusses a new type of aerial projectile (strafing ammunition) introduced at military strafing ranges. This illustrates the problem with past scoring systems concerning scoring inaccuracies that may be caused by projectiles that have muzzle velocity and ballistic parameters that do match the fixed projectile caliber and signal threshold parameters programmed into the scoring system.
g. Sniper Locator Finds Shooter Quickly, National Defense Magazine (November 1996), discusses a sniper location system that uses a single transducer to determine the location of the originating weapon and projectile flight path trajectory. The system uses the aforementioned amplitude scoring process and does not perform any scoring, trend or archival functions.
h. Arcata Associates, Inc., ARCATA/ADI Air-to-Ground Scoring System—System Test Report (1995), discusses attempts to improve the accuracy of past scoring systems caused by inadequate transducer timing, transducer signal processing and the affects of weather factors on system accuracy.
i. Oehler Research, Inc., Enhanced Acoustic Scoring System—Informal Report (1995) discusses attempts to improve the accuracy of past scoring systems by experimenting with a variety of transducer arrays and iterative formulae.
j. Cartwright Electronics, Executive Summary CEI-2728 Area Weapons Scoring System (1990), discusses a detonation scoring subsystem for determining the detonation location of explosive aerial rockets fired by helicopter gunships. The system uses four transducers to sample the shock waves propagated by the rocket detonations and requires the operator to manually input the caliber of the aerial projectile (rocket). The system does not compute any projectile velocity data, nor does the system take into account the range or relative movement of the firing aircraft.

In contrast to the aforementioned references, this invention use a computer-implemented iterative algorithm to calculate the actual location of each aerial projectile impact in a strafing burst, its dive angle, heading angle, and weapon caliber, and the burst firing range and approximate firing range of the aircraft. Additionally in this invention, ambient atmospheric temperature and wind velocity are automatically measured and listed with the computed parameters, thereby providing the operator with a comprehensive set of scoring data for each strafing pass. This invention enables the operator to define scoring area shapes and sizes that may be customized to the physical strafe target, thereby improving scoring accuracy. The strafe target can be offset from the system transducers allowing the scoring area to be coincident with the physical strafe target and independent of the location of the transducer array.

The iterative algorithm process implemented by this invention utilizes the difference in arrival times of the aerial projectile shock waves between the array of transducers rather than utilizing the amplitude of the signal output of a single transducer. Eliminating the scoring dependence on the transducer signal amplitude eliminates the numerous causes of past scoring processes inaccuracies. Since the process of this invention is independent of the amplitude of the transducers' signal outputs, the caliber and shape of aerial projectiles, differing projectile velocities, firing range, speed of the strafe aircraft, and differing transducer sensitivities will not adversely affect projectile scoring accuracy.

By calculating the differences in arrival times between at least three of the arrayed transducers, the algorithm implemented by this invention permits a computed solution of where each aerial projectile passes in relation to the transducers. The use of a second row of transducers in line with the transducer row nearest the target allows for computation of the projectile speed, dive angle, and heading angle. Further, the algorithm implemented by this invention extrapolates the firing range of the strafing aircraft by using a stored ballistic table for the projectile caliber detected by the invention.

By this invention, computed impact points are quantitatively scored as a hit or miss depending on whether they pass within the selected scoring area and shape projected onto the physical range target. Both hits (on-target) and misses (off-target) are plotted in relation to the scoring area to give an operator a visual hardcopy record of the aerial projectile scoring pattern and the sequence in which the projectiles impacted the strafe target. Finally, the projectile impact points and the computed and measured projectile data are stored in the computer memory for later scoring trend analysis.

For the foregoing reasons, there is a need for an improved computer-based time-difference process and apparatus for scoring supersonic aerial projectiles directed at a strafe target.

BRIEF SUMMARY OF THE INVENTION

The present invention is directed to a computer-based process and apparatus that satisfies the need for an improved time-difference process and apparatus for scoring supersonic aerial projectiles directed at a strafe target.

A process and apparatus having features of this invention comprises an array of at least six transducers disposed proximately to a strafe target, the transducers being independently and automatically operable to transmit analog signals in response to the acoustic shock waves propagated by supersonic aerial projectiles directed at the strafe target. A multichannel signal processor is coupled to the transducers for receiving the analog signals and converting the analog signals to equivalent digital signals. The signal processor transmits the signals to at least one general-purpose digital computer coupled to the signal processor. The computer implements an iterative scoring algorithm, which measures and processes the digital signals for computing scoring data for the supersonic aerial projectiles.

In accord with one aspect of this invention, the computer implements the algorithm to determine scoring data for the supersonic aerial projectiles by measuring the time differences of arrival of the acoustic shock waves at each of the transducers, and comparing the scoring data with target data from the physical strafe target.

Preferably, the multichannel signal processor is capable of automatically triggering, sampling and recording in response to the acoustic shock waves at a minimum of one hundred kilocycles per channel.

Another aspect of this invention is a weather station coupled to the computer for automatically transmitting ambient atmospheric temperature data, wind velocity data and barometric pressure data to the computer, such weather data being subsequently processed by the computer as part of the iterative algorithm process of scoring the supersonic aerial projectiles.

Preferably, computer implementation of the iterative scoring algorithm includes processing the scoring data and the target data by indicating a quantitative and qualitative comparisons of the data to an operator by a visual display or by printout from a computer printer.

Also preferably, computer implementation of the iterative algorithm includes processing the comparison of calculated projectile scoring data with the target data by storing the quantitative comparisons in the computer memory for strafing trend analysis and archival use by the operator.

The process and apparatus of this invention accurately and rapidly displays, stores, and prints supersonic aerial projectile scoring data to an operator by: measuring supersonic aerial projectile acoustic shock waves received by an array of transducers, transmitting the transducer signals to an all-purpose digital computer, measuring weather data, and by implementing an iterative scoring algorithm to use the signal data and the weather data to iteratively calculate scoring data. The apparatus compares the scoring data to target data from the strafe target and indicates the quantitative and qualitative comparison of the data to the operator by display or printout.

One object of this invention is to provide a process and apparatus for scoring supersonic aerial projectiles that uses measuring the time-differences of arrival off the acoustic shock waves propagated by the projectiles at an array of at least six transducers to calculate scoring data.

Another object of this invention is to calculate and indicate the impact points (or nearest point of approach) of the projectiles on a strafe target for both on-target and off-target projectiles.

An additional object is to provide a scoring apparatus that does not have a defined non-tactical scoring area fixed at the location of a transducer, but instead has a scoring area selectable by the operator to conform to the actual physical location and shape of the strafe target.

A further object is to provide a process and apparatus that does not use fixed projectile calibers and signal parameters to calculate projectile scoring data.

An object of this invention is to automatically sample ambient atmospheric temperature and wind velocity data, and process this data by the computer implemented scoring algorithm, to improve projectile scoring accuracy.

Still another object is to estimate the firing range of the strafe aircraft by the computer-implemented scoring algorithm.

Yet another object of this invention is to indicate to the operator complete projectile scoring data, including projectile velocity, projectile dive angle, projectile heading angle, estimated strafe aircraft firing range and projectile burst patterns (e.g., physical patterns of impact of the projectiles upon a strafe target).

Still other objects of the present invention will become readily apparent to those skilled in this art from the following description of the invention, wherein only the preferred embodiments of the invention is disclosed, simply by way of illustration of the best mode contemplated of carrying out this invention. As will be realized, the invention is capable of other and different embodiments and its several details are capable of modifications in various obvious respects, all without departing from the invention. Accordingly the drawings and description are to be regarded as illustrative in nature, and not as restrictive.

BRIEF DESCRIPTION OF THE SEVERAL VIEWS OF THE DRAWING

FIG. 7 is a table of typical supersonic aerial projectile scoring data for eight iterations of the scoring algorithm process, in accordance with this invention.

DETAILED DESCRIPTION OF THE INVENTION

Figure 1:
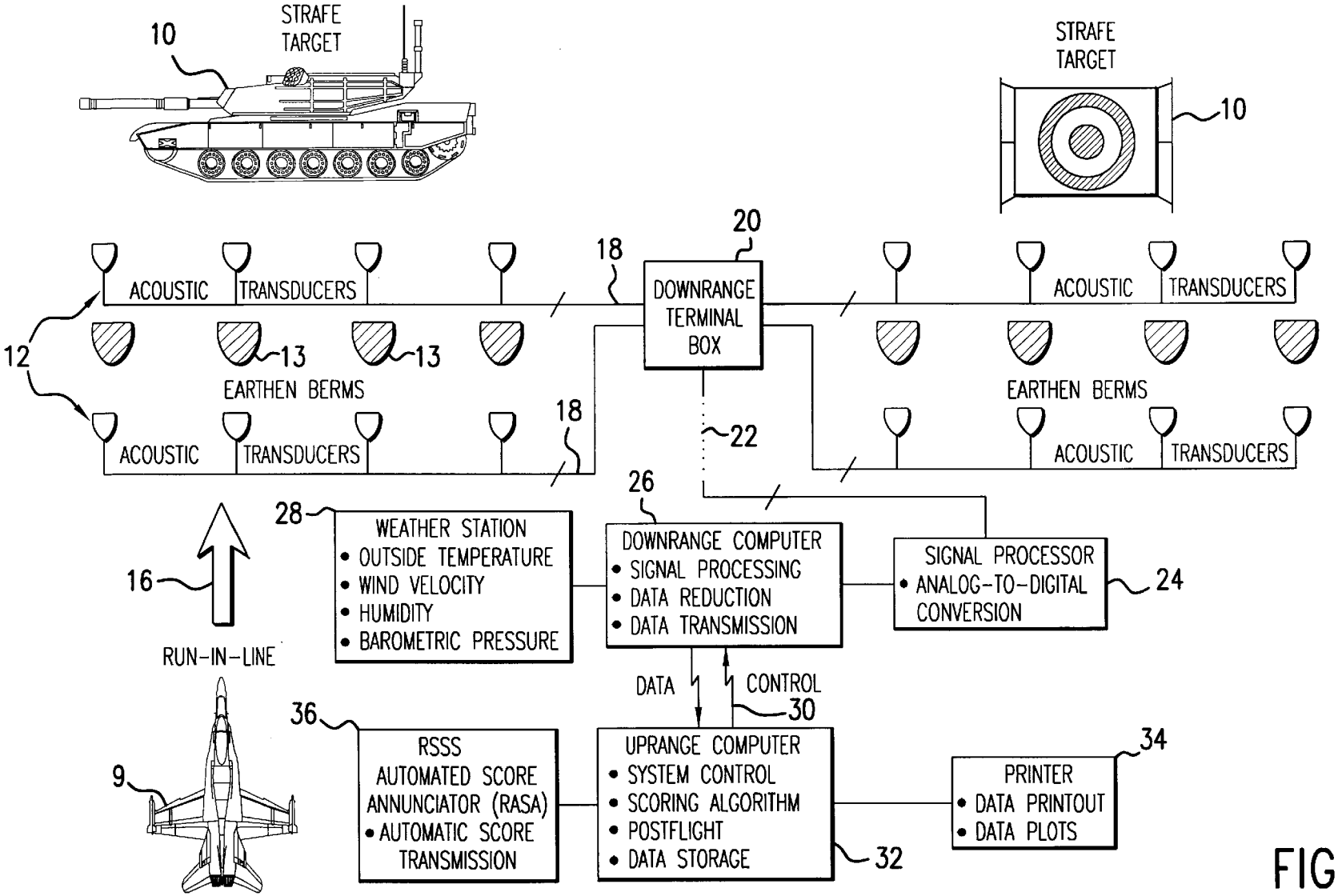
FIG. 1 is a schematic view of a typical aerial projectile strafing range, in accordance with this invention.

FIG. 1 illustrates a schematic view of a typical aerial projectile strafing range in which the preferred embodiment of the invention is used. Although the claims, infra, and the following detailed description in part will relate to and describe, for the purposes of full, concise, clear and exact illustration and explanation, the preferred embodiment of the invention in terms of a single strafe target, FIG. 1 illustrates that another embodiment of the invention may also include a plurality of strafe targets and corresponding scoring apparatus.

As illustrated by FIG. 1, the apparatus for scoring supersonic aerial projectiles, said projectiles being fired at a strafe target 10 by a strafing aircraft 9 travelling on a flight path generally coincident with a Run-In-Line 16, comprises an array of transducers 12 arranged proximate to the strafe target 10. The transducers 12 are coupled by a first buried cable 18 for transmitting the signals generated by the transducers 12 to a downrange terminal box 20. The downrange terminal box 20 is coupled by a second buried cable 22 for further transmitting the signals to a signal processor 24, and the signal processor 24 transmits processed signals to a downrange computer 26. Weather station 28 is coupled to, and transmits weather data to, the downrange computer 26. The downrange computer 26 calculates time-difference of arrival data by using the processed signals from the signal processor 24, and transmits the time-difference data and the weather data to an uprange computer 32 via a modem line 30. The uprange computer 32 implements the scoring algorithm process of the preferred embodiment of the invention to calculate scoring data by processing the time-difference of arrival data and the weather data received from the downrange computer 26. The uprange computer 32 communicates the scoring data to an operator by printer, display and annunciation as described in FIG. 2 infra.

Figure 2:
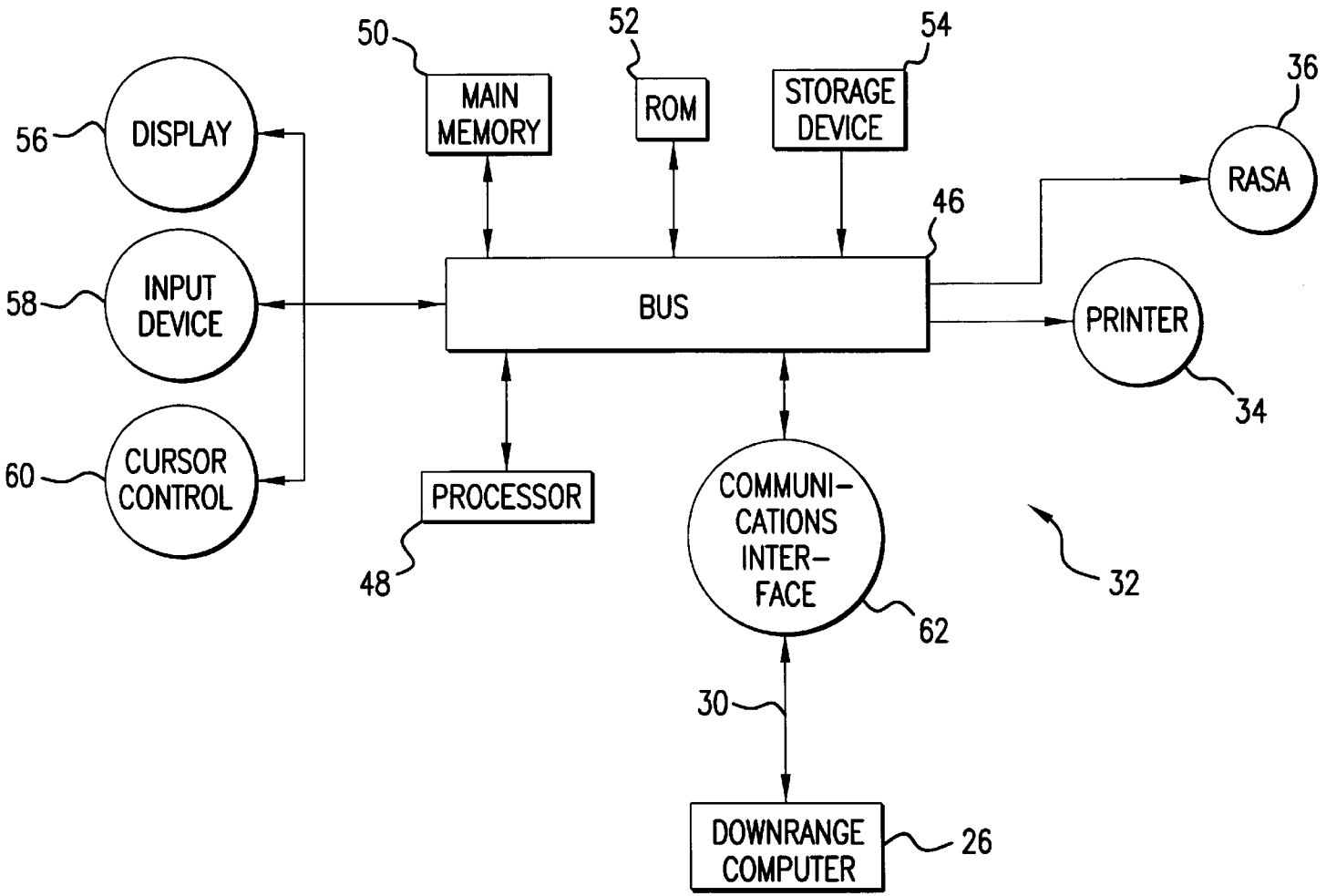
FIG. 2 is a schematic block diagram of the major computing and processing components of the uprange computer, in accordance with this invention.

Detailed schematic drawings of the apparatus of an embodiment of this invention may be found in the United States Navy system manual entitled, *Improved Remote Strafe Scoring System* (*IRSSS*) *System Manual MCAS Yuma Cactus Range West,* FIGS. 2.1, 2.3, Table 6.3, Appendix B FIGS. B-1 through B-17 (Naval Warfare Assessment Station, Corona, Calif., Oct. 5, 2000 draft edition), which is incorporated herein by reference.

Referring further to FIG. 1, in the preferred embodiment of the invention, the transducers 12 comprise an array of eight individual transducers, the array being coupled in series and disposed in two groups consisting of a front transducer row and a back transducer row. Each transducer row consists of four transducers, and the rows are arranged parallel to each other and proximate to the strafe target 10. Berms 13, comprised of earth or other protective material, may be appropriately positioned to shield the transducers 12 from supersonic aerial projectiles fired by the strafe aircraft 9.

Preferably, the transducers 12 of the front and back transducer rows are mounted on mounting rails, typically one mounting rail each for the front and the back transducer rows, or equivalent structures such that the height-above-ground of each transducer is the same as every other transducer. The mounting rails are disposed parallel, square and horizontally level in relation to each other and the longitudinal axis of each mounting rail is substantially normal to the axis of the RIL 16. Preferably, the back mounting rail (e.g., the mounting rail nearest the strafe target 10) is located twenty feet from the strafe target 10 along the axis of the RIL 16, and the front mounting rail is located fifty feet from the strafe target 10 along the axis of the RIL 16. Within each transducer row, the transducers 12 are laterally spaced upon their respective mounting rails at intervals of between five and fifteen feet of immediately adjacent transducers, said spacing being physically selected by the operator depending upon the caliber (e.g., diameter) of supersonic aerial projectile being scored and the size of the strafe target 10. A transducer spacing of fifteen feet is optimal for most scoring scenarios. The transducers 12 are further arrayed so that the transducers 12 of the front row are aligned in the same axis as the corresponding transducer 12 in the back row. The center transducers of the front and the back transducer rows are substantially in-line with the estimated strafing flight-path of the strafing aircraft 9, said estimated strafing flight path depicted in FIG. 1 by a Run in Line (RIL) 16. Thusly, the strafing aircraft 9, proceeding on the RIL 16, fires aerial projectiles at the strafe target 10, whereby the supersonic aerial projectiles pass over and above the array of the transducers 12 in route to impacting on or in vicinity of the strafe target 10.

The transducers 12 function to receive sound pressure generated by the acoustic shock waves propagated by the supersonic aerial projectiles as they pass over or above the transducers 12 in route to the strafe target 10. The transducers 12 automatically activate upon arrival of the supersonic shock waves and automatically convert the sound pressure energy of the shock waves into equivalent analog electrical signals. Accordingly, the transducers 12 must be capable of receiving high sound pressure levels in excess of 140 decibels. Typically, the transducers 12 are commercial microphone pressure-type transducers that produce electrical signals by moving a voice coil mounted to a moving diaphragm through a (neodymium-magnet) magnetic field. Alternatively, commercial condenser or piezoelectric pressure-type transducers may be employed, provided that a suitable source of preamplification power is provided for amplifying the analog electrical signals generated by the transducers 12. Optimally, the transducers 12 utilize a cardiod polar sensing pattern, suitable for sampling sound pressures generated from the direction of the strafe aircraft 9. Alternatively, an omnidirectional-type sensing pattern may be employed if the operator determines that it is desirable to sense sound pressure generated from multiple directions relative to the array of the transducers 12.

Analog electrical signal generated by each of the transducers 12 are transmitted via a first buried cable 18 to a downrange terminal box 20. The first buried cable 18 is buried in the earth or similarly protected to shield the cable from the aerial projectiles and from debris thrown from the strafe target 10 when it is impacted by the aerial projectiles. Preferably, the first buried cable 18 consists of four or eight twisted pairs of 18 American Wire Gauge (AWG) wire. A metallic shield around the wire pairs functions to protect the analog electrical signals transmitted therein from outside electrical interference.

The analog electrical signals generated by the transducers 12 and transmitted via the first buried cable 18 are received by the downrange terminal box 20, and said signals are then transmitted to a signal processor 24 via second buried cable 22. Second buried cable 22 is buried for the same reasons as the first buried cable 18, and second buried cable 22 typically consists of a single multi-pair shield type cable suitable for transmitting the analog electrical signals from the transducers 12 and the downrange terminal box 20.

Preferably, signal processor 24 is a commercial multichannel analog-to-digital electrical-signal conversion apparatus, configured so that each of the transducers 12 connects to a separate channel within the signal processor 24. Thus, in the preferred embodiment of the invention the signal processor 24 must have a minimum capacity of eight channels, with one channel dedicated to each of the transducers 12. The functions of the signal processor 24 are to automatically receive, sample and record the analog electrical signal generated by the transducers 12; to automatically convert the analog signals into equivalent digital signals; and to automatically transmit the recorded digital signals to a downrange computer 26. Preferably, the signal processor 24 contains a digital signal processor or equivalent device that enables the signal processor 24 to automatically detect the simultaneous arrival of analog electrical signals from any one, plurality of, or all of the transducers 12, start simultaneous high-speed recording of the analog electrical signals for a pre-determined sampling time (e.g., the signal processor 24 must have a multi-channel triggering capability), and either store the signal data internally or pass the data to a external memory fast enough to avoid overrunning the signal processor 24 internal storage buffer. The minimum required signal recording speed for the signal processor 24 is 100 kilocycles per second per channel or 800 kilocycles aggregate for the eight channels corresponding to the transducers 12. In the preferred embodiment, the signal processor 24 is capable of a signal recording speed of 100 to 125 kilocycles per second per channel or at least 1000 kilocycles per second aggregate.

Therefore, signal processor 24 functions to automatically sample and record analog electrical signals generated by the transducers 12 in response to the sound pressure generated by the acoustic shock waves of the supersonic aerial projectiles passing above the transducers 12. The signal processor 24 further functions to automatically convert the analog electrical signals received from the transducers 12 to equivalent recorded digital electrical signals. Signal processor 24 also functions to automatically transmit the recorded digital electrical signals to a downrange computer 26.

Referring further to FIG. 1, the downrange computer 26 receives the recorded digital electrical signals from the signal processor 24. In the preferred embodiment of the invention, the downrange computer 26 is a commercial all-purpose digital microcomputer, suitable for operation for prolonged periods of time in harsh environmental conditions, and configured with a minimum of 128 megabytes of random access memory (RAM) to allow large amounts of signal data to be recorded and processed. The signal processor 24 is coupled to the downrange computer 26 PC via a commercial high-speed enhanced parallel port (EPP) microcomputer card disposed upon the downrange computer 26. The EPP microcomputer card of the downrange computer 26 enables sustained transfer of the recorded digital electrical signals from the signal processor 24 to the downrange computer 26 at a maximum data transfer rate of 2 megabytes per second. Additional EPP ports may be added to the downrange computer 26 if additional or simultaneous strafe target signal processing is desired: for example, to permit simultaneous scoring of a plurality of strafe targets, said plurality of strafe targets being illustratively depicted in FIG. 1.

Downrange computer 26 functions to process the digital electrical signals received from the signal processor 24; said processing comprising calculating which indexed data points the shock waves arrived at on each channel of the signal processor 24. Given these calculated points and the fixed sampling rate of the signal processor 24, the downrange computer further calculates accurate shock wave Time-Differences-Of-Arrival (TDOA) for each of the transducers 12 relative to each of the other transducers 12. Thusly, the downrange computer 26 calculates the time differences of arrival at the each of the transducers 12 of the acoustic shock waves propagated by the supersonic aerial projectiles fired by the strafe aircraft 9 at the strafe target 10.

A weather station 28 is coupled to the downrange computer 26 via a first standard commercial serial communications (COM) port disposed on the downrange computer 36. The weather station 28 automatically samples local environmental conditions such as wind velocity (consisting of wind direction and wind speed data), ambient air temperature, and barometric pressure. The scoring algorithm process described infra uses ambient air temperature data to compute the local speed of sound, since local speed of sound data is required to accurately implement the scoring algorithm process. Further, wind speed and direction data are used by the scoring algorithm process to computationally compensate for the shift in the acoustic shock waves under high wind conditions and to minimize scoring algorithm calculation errors.

Weather station 28 functions to automatically transmit weather data, consisting of wind speed, wind direction (measured in degrees clockwise from magnetic North), ambient air temperature and barometric pressure data to the downrange computer 26 at the time the analog electrical signals from the transducers 12 are received by the signal processor 24. Preferably data is transmitted from the weather station 28 to the downrange computer 26 using a RS-232 communications interface, with an asynchronous data rate of 4800 baud. The weather station 28 is configurable by the operator so that the weather station 28 will automatically transmit said weather data to the downrange computer 26 at intervals of approximately one second. In the preferred embodiment, the weather station 28 employs an integrated wind anemometer/wind vane and a separate temperature probe mounted inside a radiation shield to gather the weather data disclosed above.

Therefore, the signal processor 24 and the weather station 28 are coupled to the downrange computer 26. The downrange computer 26 controls the operation of the signal processor 24 and processes recorded digital electrical signal from the signal processor 24 and weather data, consisting of wind velocity, ambient air temperature and barometric pressure data, from the weather station 28. The downrange computer 26 calculates TDOA data for each of the transducers 12 relative to each of the other transducers 12 by processing recorded digital electrical signal data received from the signal processor 24.

The downrange computer 26 transmits the TDOA data and the weather data to an uprange computer 32. In the preferred embodiment of the invention, the downrange computer 26 transmits the TDOA data and the weather data, and receives control from, the uprange computer 32 via a modem line 30. The modem line 30 interfaces with the downrange computer 26 via a second COM port disposed on the downrange computer 26. Preferably, a RS-232 format signal from the second COM port is converted to a signal for transmission over modem line 30; modem line 30 effectuating transmission to the uprange computer 32 using a radio frequency audio channel through a commercial four-wire lease line modem and the second COM port. Alternatively, if the downrange computer 26 and the uprange computer 32 are located fifty feet or more from each other, it is preferred to replace modem line 30 with a pair of wireless modems for providing data communications between the downrange computer 26 and the uprange computer 32.

The uprange computer 32 receives the TDOA data and the weather data from the downrange computer 26 via the modem line 30. The uprange computer 26 implements the scoring algorithm process described infra using an iterative calculation process to calculate the impact point of each of the supersonic aerial projectiles upon the strafe target 10. The scoring algorithm implemented by the uprange computer also calculates the supersonic aerial projectile dive angle and approach heading, aerial projectile velocity and the aerial projectile acoustic shock wave mach angle. The uprange computer 32 implements the scoring algorithm process individually for each supersonic aerial projectile detected by the transducers 12 and calculates the impact point of each of such supersonic aerial projectiles upon the strafe target 10. The uprange computer 32 then overlays the calculated impact points onto a graphical silhouette of the strafe target 10 and indicates the overlay to the operator as, for example, illustrated by FIG. 8 infra.

In operation, the apparatus depicted by FIG. 1 is used in the following manner. The strafe aircraft 9, proceeding on a flight patch generally defined by the RIL 16, fires supersonic aerial projectiles at the strafe target 10. The supersonic aerial projectiles, while in flight towards intended impact on the strafe target 10, pass over and above the array of the transducers 12. The acoustic shock waves propagated by the supersonic aerial projectiles reach the transducers 12 and automatically trigger the transducers 12 to generate analog electrical signals in response to the shock waves. Analog signals generated by the transducers 12 are automatically transmitted on the first buried cable 18 and the second buried cable 22 to the signal processor 24, which is located downrange from the transducers 12. The signal processor 24 simultaneously records on all channels and samples the analog electrical signals transmitted from each of the transducers 12. The signal processor 24 is further used to convert the analog electrical signals from the transducers 12 to equivalent digital electrical signals. The signal processor 24 automatically stops recording after a specified number of signal sample points are obtained.

Recorded digital electrical signals are automatically transmitted from the signal processor 24 to the downrange computer 26. Downrange computer 26 processes the recorded digital signals to calculate which indexed data point each shock wave arrived at on each channel. Given these indexed data points and the known sampling rate of the signal processor 24, accurate shock wave time differences of arrival (TDOA's) are calculated by the downrange computer 26 for each of the transducers 12 relative to the other transducers. Local environmental conditions, consisting of wind velocity, ambient air temperature, and barometric pressure are automatically sampled by the weather station 28 at the time the signal processor 24 is triggered, and the weather data is automatically transmitted to the downrange computer 26.

The downrange computer 26 transmits the TDOA data and the weather data to the uprange computer 32 via modem line 30. The uprange computer 32 implements the scoring algorithm process, described infra, to calculate the supersonic aerial projectile impact point on the strafe target 10, projectile dive angle and approach heading, projectile velocity, and supersonic aerial shock wave mach angle. The uprange computer 32 implements the scoring algorithm process individually for each supersonic aerial projectile detected by the transducers 12, and the impact points of all projectiles are then overlaid onto a silhouette of the strafe target 10. The uprange computer 32 calculates number of projectile hits on the strafe target 10, mean impact point, and the burst pattern (e.g., the grouping of individual projectile impacts) relative to the strafe target 10 center point (including off-target rounds). Scoring data is displayed and annunciated by the uprange computer 32 to the operator as described below.

Finally in reference to FIG. 1, it can be appreciated from the disclosure of the apparatus of the preferred embodiment of the invention supra that the invention detects supersonic aerial projectiles without reference to the caliber (diameter) of the projectiles detected. However, since the caliber and velocity of the projectiles will proportionally affect the magnitude of the acoustic shock wave energy generated by same, the minimum range of calibers of supersonic aerial projectiles typically detected by the apparatus are between seven and thirty millimeters. Moreover, since the apparatus of the invention operates by detecting acoustic shock waves propagated by supersonic aerial projectiles, the projectiles must be travelling a minimum speed of Mach 1.1 to be detected by the apparatus of the invention (e.g., subsonic projectiles cannot be detected by the invention). The scoring area will vary in relation to the magnitude of the acoustic shock wave detected by the apparatus of the invention and does not define the target area. The size, shape and location of the strafe target 10 defines the target area for determining the number of on-target "hits" using the scoring algorithm process described infra. Typically, smaller supersonic aerial projectiles such as the 7.62-millimeter caliber may be accurately scored by an embodiment of the invention to about thirty feet from the array of the transducers 12. Larger projectiles such as the thirty-millimeter caliber may be accurately scored by an embodiment of the invention to about one hundred feet from the array of the transducers 12.

FIG. 2 is a schematic block diagram that illustrates an embodiment of the uprange computer 32 by which the scoring algorithm process described infra may be implemented. In the preferred embodiment, the uprange computer 32 is a commercial all-purpose digital computer that includes a bus 46 or other communication mechanism for communicating information, and a processor 48 coupled with the bus 46 for processing information. The uprange computer 32 also includes a main memory 50, such as a random access memory (RAM) (as described supra, a minimum of 128 megabytes of RAM is preferred) or other dynamic storage device, coupled to bus 46 for storing information and instructions to be executed by the processor 48. The main memory 50 may also be used for storing temporary variable or other intermediate information during execution of instructions to be executed by the processor 48. The uprange computer 32 further includes a Read Only Memory (ROM) 52 or other static storage device coupled to the bus 46 for storing static information and instructions for the processor 48. A storage device 54, such as a magnetic disk or optical disk, is provided and is coupled to the bus 46 for storing information and instructions.

The uprange computer 32 may be coupled via the bus 46 to a display 56, such as a cathode ray tube (CRT) or a flat-panel Active Matrix Liquid Crystal Display (AMLCD), for displaying scoring data to the operator. An input device 58, including alphanumeric and other keys, is coupled to the bus 46 for communicating information and command selections to the processor 48. Another type of operator-input device is cursor control 60, such as a mouse, a trackball, or cursor direction keys for communicating direction information command selections to the processor 48 and for controlling cursor movement on the display 56. This embodiment of the input device 58 typically has two degrees of freedom in two axes, a first axis (e.g., x) and a second axis (e.g., y), that allows the input device to specify positions in a plane.

The invention is related to the use of the uprange computer 32 to implement a scoring algorithm that accomplishes a time-difference process of scoring supersonic aerial projectiles. According to one embodiment of the invention, implementing a scoring algorithm that accomplishes a time-difference process of scoring supersonic aerial projectiles is provided by the uprange computer 32 in response to the processor 48 executing one or more sequences or one or more instructions contained in the main memory 50. Such instructions may be read into the main memory 50 from another computer-readable medium, such as the storage device 54. Execution of the sequences of instructions contained in the main memory 50 causes the processor 48 to implement the scoring algorithm process described infra. One or more processors in a multi-processing arranged might also be employed to execute the sequences of instructions contained in the main memory 50. In alternative embodiments of the invention, hard-wired circuitry may be used in place of or in combination with software instructions to implement the invention. Thus, embodiments of the invention are not limited to any specific combination of hardware circuitry and software.

In further reference to FIG. 2, the term "computer-readable medium" as used herein refers to any medium that participates in providing instructions to the processor 48 for execution. Such a medium may take many forms, including, but not limited to, non-volatile media: including, for example, optical or magnetic disks, such as the storage device 54. Volatile media include dynamic memory, such as the main memory 50. Transmission media include coaxial cables, copper wire, and fiber optics, including the wires that comprise the bus 46 and the modem line 30. Transmission media can also take the form of acoustic or light waves, such as those generated during radio frequency (RF) and infrared (IR) data communications. Common forms of computer-readable media include, for example, floppy disk, a flexible disk, hard disk, magnetic tape, and other magnetic medium, a CD-ROM, DVD, or any other optical medium, punch cards, paper tape, or any other physical medium with patterns of holes, a RAM, a PROM, an EPROM, a FLASH-EPROM, any other memory chip or cartridge, or any other medium from which the uprange computer 32 can read.

Continuing in reference to FIG. 2, various forms of computer-readable media may be involved in carrying out one or more sequences or one or more instructions to the processor 48 for execution. For example, instructions may initially be borne on a magnetic disk of a computer remote from the strafing range and apparatus depicted by FIG. 1. The remote computer can load the instructions into its dynamic memory and send the instructions over a telephone line using a modem. A modem local to the uprange computer 32 may receive the data on the telephone line and use an infrared transmitter to convey the data to an infrared signal. An infrared signal detector coupled to the bus 46 can receive the data carried in the infrared signal and pace the data on the bus 46. The bus 46 carries the data to the main memory 50, from which the processor 48 retrieves and executes the instructions. The instructions received by the main memory 50 may optionally be stored on the storage device 54 after execution by the processor 48.

The uprange computer 32 also includes a communication interface 62 coupled to the bus 46. The communication interface 62 provides a two-way data communication to the downrange computer 26 via the modem line 30. The communication interface 62 functions to receive TDOA data and weather data from the downrange computer 26, and to send instructions to the downrange computer 36 from the operator, via the input device 58 or the cursor control 60, or from the uprange computer via the bus 46. As another example, the communications interface 62 may be an integrated signal services (ISDN) network card or a modem to provide a data communication connection to a compatible local area network (LAN). Wireless links may also be implemented. In any such implementation, the communication interface 62 sends to and receives from the downrange computer 32 electrical, electromagnetic or optical signals that carry digital data streams representing various type of information.

The bus 32 is further coupled to a printer 34, for example a commercial laser, inkjet, thermal or dot-matrix computer printer, suitable to printing out scoring data calculated by the scoring algorithm process described infra and as implemented by the uprange computer 32. The bus 46 is also coupled to a Remote Supersonic Scoring System Score Annunciator (RASA) 36. The RASA 36 is a stand-alone military apparatus that receives scoring data from the uprange computer 32 and automatically triggers a radio transmitter to relay the scoring data to the pilot of the strafing aircraft 9 using digitized words.

In operation, the operator uses the uprange computer 32 to control, via the bus 46, the communications interface 62 and the modem line 30, the downrange computer 26 concerning how the downrange computer 26 is configured for the desired of strafe scoring. The uprange computer 32 receives the TDOA data and the weather data from the downrange computer 26 and implements the scoring algorithm process, using the combination of the main bus 46, the processor 48, the main memory 50, the ROM 52, and the storage device 54, to calculate scoring data for supersonic aerial projectiles detected by the transducers 12. The operator is informed of scoring data, produced by the scoring algorithm process as implemented by the uprange computer 32, by graphical and tabular displays of the scoring data indicated on the display 56, the printer 34 and the RASA 36. The uprange computer 32 also stores, in the storage device 54, the scoring data for archiving and later analysis by the operator.

Figure 3A:
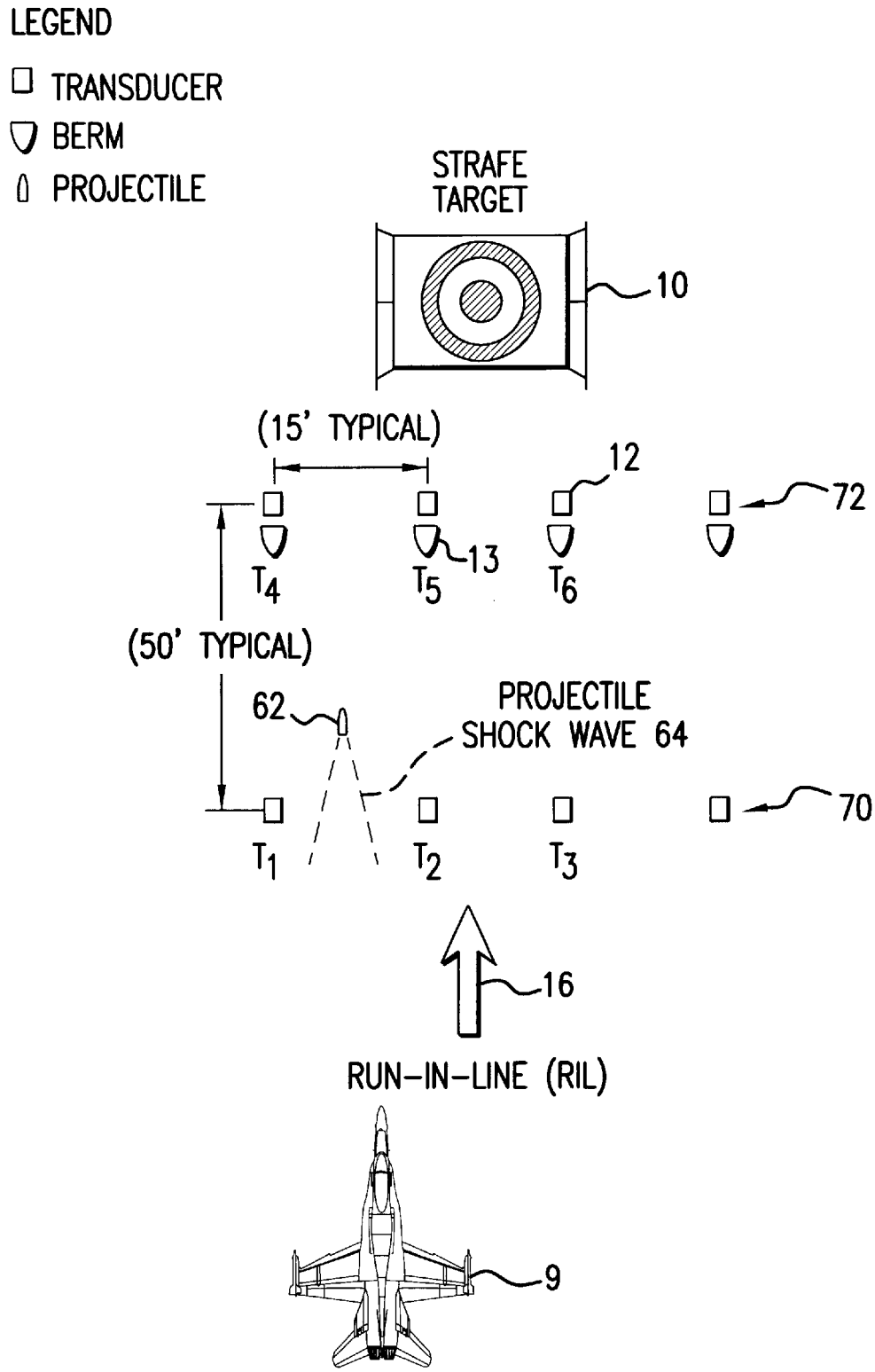
FIG. 3A is a schematic plan view of a supersonic aerial projectile in route to impact on a strafe target, in accordance with this invention.

FIG. 3A is a schematic plan view illustrating a typical supersonic strafe projectile 62 in route to intended impact on the strafe target 10. The supersonic aerial projectile 62 is fired from the strafe aircraft 9 as the aircraft proceeds on a flight path generally coincident with the Run-In-Line (RIL) 16. As illustrated, the passage of the supersonic flight projectile 62 through the atmosphere propagates an acoustic shock wave 64, said acoustic shock wave travels through the atmosphere at the local speed of sound and arriving at the transducers 12, following the passage of the supersonic projectile 62 over and above the front transducer row 70 and the back transducer row 72, in route to impact on the strafe target 10.

Figure 3B:
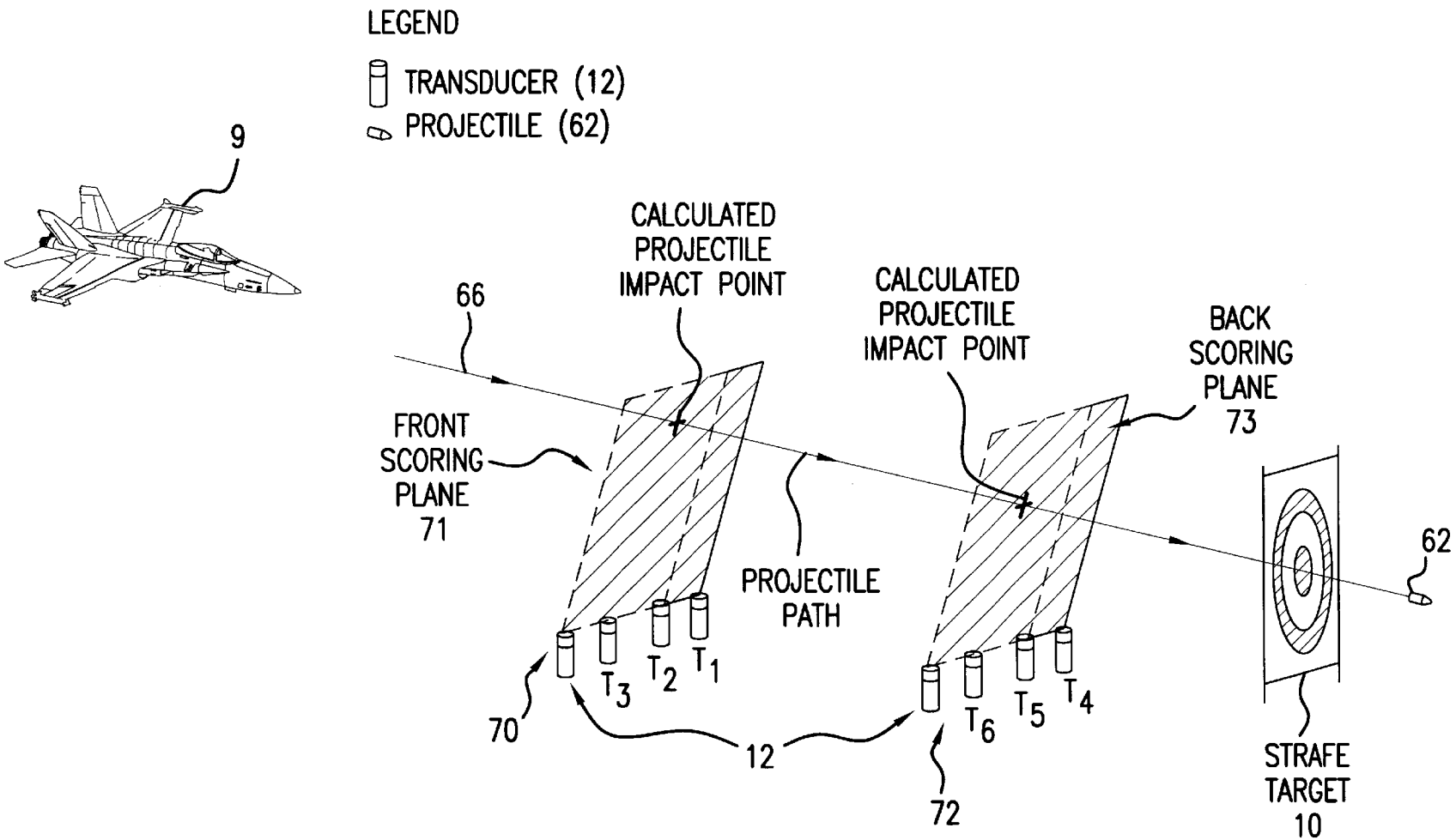
FIG. 3B is a schematic perspective view of a supersonic aerial projectile in route to impact on a strafe target, in accordance with this invention.

FIG. 3B is an schematic perspective view further illustrating the flight path 66 of the supersonic strafe projectile 62 in route to impact on the strafe target 10. While in route to impact on the strafe target 10, the flight path 66 of the supersonic strafe projectile 62 passes through two imaginary planes normal to the flight path 66, said imaginary planes respectively intersecting lines drawn through the lateral axis of the array of the transducers 12 comprising, respectively, the front transducer row 70 and the back transducer row 72. The imaginary plane for the front transducer row 70 is denoted the front scoring plane 71 and the imaginary plane for the back transducer row is denoted the back scoring plane 73. The scoring algorithm process described infra determines scoring data for the supersonic aerial projectile 62 by using hyperbolic line equations to compute the impact points of the projectile on the front scoring plane 71 and the back scoring plane 73 during said projectile's transit to impact on or near the strafe target 10.

In operation, the scoring algorithm process described infra computes the impact (e.g., scoring) location of the supersonic projectile on (or nearby) the strafe target 10 by calculating the differences in arrival times of the acoustic shock wave 64 between at least three of the transducers 12 of the front transducer row 70. By calculating the differences in the arrival times of the acoustic shock wave 64 between at least three of the transducers 12 of the front transducer row 70, the scoring algorithm process described infra computes the Cartesian coordinates of where the supersonic strafe projectile impacts the front scoring plane 71. By further computing impact coordinates for the back transducer row 72 by the same process, the scoring algorithm process described infra computes the supersonic strafe projectile 62 speed, dive angle and heading angle. The firing range of the strafe aircraft 9 (e.g., the firing distance from the strafe aircraft to the strafe target) is computed from the projectile speed using a ballistic table for the projectile caliber detected by the scoring apparatus described supra.

The scoring algorithm process described infra scores the supersonic strafe project 62 as a "hit" or a "miss" depending upon whether the computed projectile impact point on the front scoring plane 71 coincides with the silhouette of the strafe target 10 when the computed impact point is overlaid onto a silhouette of the strafe target 10 by the uprange computer 32. Hits and misses are plotted in relation to the front scoring plane 71 projected onto a graphical silhouette of the strafe target 10 to indicate the projectile impact point to the operator, and for multiple supersonic projectiles, the scoring (strafing) pattern and the order in which the projectiles impacted on the strafe target 10.

The projectile impact points on the strafe target 10, and the computed and measured scoring data are stored in the memory (e.g., in the main memory 50, ROM 52, or the storage device 54) of the uprange computer 32 for later use in scoring analysis and re-display as desired by the operator.

Figure 4:
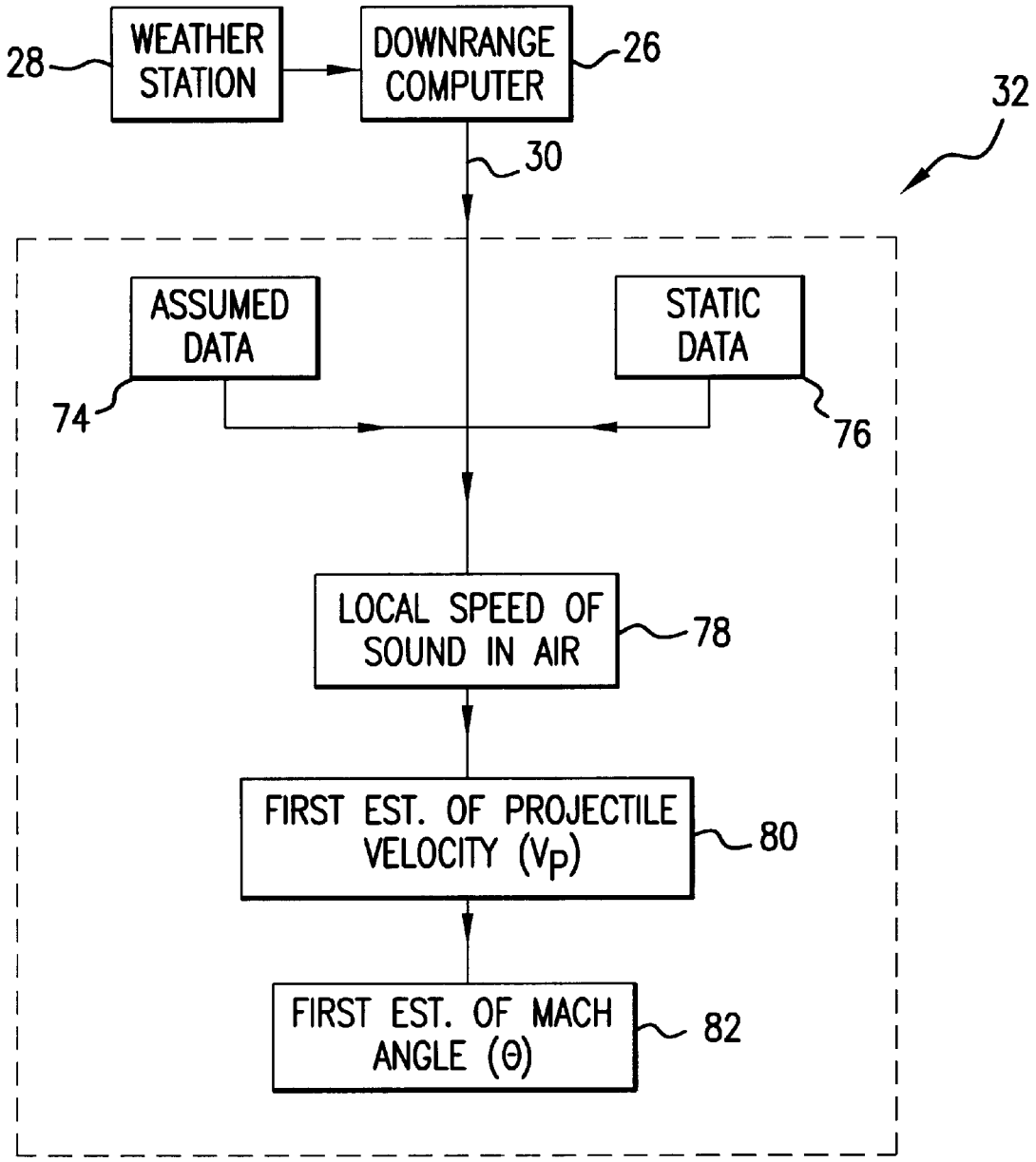
FIG. 4 is a schematic block diagram of the initialization of the scoring algorithm process, in accordance with this invention.

FIG. 4 is a schematic block diagram illustrating how initialization of the scoring algorithm process is implemented by the uprange computer 32. Initialization of the scoring algorithm process requires that assumed data 74, static data 76 and data from the downrange computer 26 be provided to the uprange computer 32.

The assumed data 74 are computational assumptions upon which accurate implementation of the scoring algorithm process is predicated. Accordingly, the assumed data 74 consists of a first assumption that the transducers 12 described supra are arrayed in the front transducer row 70 and the back transducers row 72 such that the height-above-ground of each transducer is the same as every other transducer in the array, and that the front and the back transducers rows are disposed substantially normal to the RIL 16 of the strafe aircraft 9. The assumed data 74 consists of a second assumption that the velocity and mach angle of the supersonic projectiles 62 detected by the transducers 12 are constant during the detection period (e.g., during the period when the acoustic shock waves are detected by the transducers 12), and that the mach cone and the flight path of the supersonic projectiles 62 are linear during the detection period. The assumed data 74 are pre-programmed into the uprange computer 32 prior to implementation of the scoring algorithm process described infra, and the assumed data 74 are stored for retrieval in the main memory 50, the ROM 52 or the storage device 54 described supra.

The static data 76 are data assumed to be constant, and are entered into the uprange computer 32 by the operator prior to starting the initialization process. The static data 76 are entered by the operator prior to implementation of the scoring algorithm process by the uprange computer 32 and may be stored for retrieval in the main memory 50, the ROM 52 or the storage device 54 described supra. The static data 76 consists of transducer spacing data, strafe target spacing data, interchannel recording delay data and Run-In-Line (RIL) data. Transducer spacing data consists of the distances (in feet) between each of the transducers 12 and every other of the transducers 12. Target spacing data are the dimensions and location of the physical target(s) in relation to the transducer array. Interchannel recording delay data is the fixed interchannel delay between each of the eight channels of the signal processor 24 described supra. The RIL data is the angular offset angle, in degrees measured clockwise, of the RIL 16 from magnetic north.

Data transmitted by the downrange computer 26 to the uprange computer 32 consists of Time Difference of Arrival (TDOA) data and weather data (consisting of wind speed, wind direction and ambient air temperature data) from the weather station 28 via the downrange computer 26. The TDOA and the weather data are transmitted to the uprange computer 32, via the modem line 30, to implement the scoring algorithm process described infra.

Therefore, as schematically illustrated by FIG. 4, use of the preferred embodiment of the invention the scoring algorithm process is initialized in the following manner. The downrange computer 26 calculates TDOA data by determining the shock wave time-of-arrivals (TOA's) for each of the transducers 12 relative to the trigger event. For the downrange computer 26 to accurately calculate TOA's, the same point on the analog electrical signal waveform transmitted by each of the transducers 12 must be used in order to compute accurate TDOA's. The point on the waveform used by an embodiment of the invention is the peak of the overpressure acoustic shock wave (assumed to be represented by the maximum voltage of the analog electrical signal generated by each the transducers 12 as sampled and recorded by the signal processor 24). The downrange computer 26 calculates the TOA's for each of the transducers 12 by dividing the index number of the corresponding channel of the signal processor 24 by the channel clock rate. TDOA data are obtained by subtracting the TOA of a first transducer (T1) of the front transducer row 70 from a second transducer (T2) of the front transducer row 70.

For example, assume that transducer 1 ($T_1$) has a maximum analog signal voltage at the signal processor 24 (T1) channel index point 340 and transducer 2 ($T_2$) has a maximum analog signal voltage at the signal processor 24 (T2) channel index point 308. Further assume that the channel clock rate of the signal processor 24 is 100 kilocycles per second, and the interchannel delay (e.g., the signal processor 24 interchannel delay in recording between the channel for T1 and T2) is negligible. Thus, the TDOA for transducer T1 and transducer T2 is calculated by the downrange computer 26 as follows:

$$t_1=340/100k=3.40 \text{ milliseconds (msec), where } t_1 \text{ is the TOA of } T_1$$

$$t_2=308/100k=3.08 \text{ msec, where } t_2 \text{ is the TOA of } T_2$$

$$\text{TDOA}=t_1-t_2=3.40-3.08=0.320 \text{ msec.}$$

The TDOA for all of the transducers are calculated by the downrange computer 26 in the same way as above, and are subsequently transmitted to the downrange computer 32 via modem line 30. Weather station 28 functions to automatically transmit wind speed, wind direction, ambient air temperature and barometric pressure data to the downrange computer 26, via modem line 30, at the time the analog electrical signals from the transducers 12 are received by the signal processor 24. Therefore, the algorithm process implemented by the uprange computer receives assumed data 74, static data 36 and data from the downrange computer 26 as described above and schematically described in FIG. 4.

Referring further to FIG. 4, the preferred embodiment of the scoring algorithm process, as implemented by the uprange computer 32, is further initialized by computing the local speed of sound in air 78, the first estimated velocity of the supersonic aerial projectile 80 and the first estimated mach angle 82 of the supersonic aerial projectile.

The local speed of sound in air 78 (denoted as 'c' in the equation below) is estimated (in feet per second) by the algorithm process implemented by the uprange computer 32 using local air temperature weather data transmitted from the weather station 28 via the downrange computer 26 and the modem line 30.

For example, assuming that the weather station 28 transmits to the uprange computer 32 weather data indicating that the local ambient air temperature is 85 F., the scoring algorithm process calculates the local speed of sound in air (c) 78 as follows:

$$c=c_0*(T_k/273)^{1/2}=20.06*(T_k)^{1/2}$$

Where $c_0$=331.6 meters per second (m/s), the speed of sound at 0C.; and $T_k$ is the absolute temperature in degrees Kelvin; and 'c' is in meters per second (m/sec.):

$$c=20.06*(5/9*(85-32)+273.16)^{1/2}=348.954 \text{ m/sec}$$

$$c=1144.863 \text{ feet per second (fps)}$$

The scoring algorithm process implemented by the uprange computer 32 is further initialized by calculating the first estimate of projectile velocity 80, (denoted by $V_p$ in the equation below). (As described infra, the scoring algorithm process subsequently iterates the first estimated value to improve scoring accuracy). The first estimate of projectile velocity 80 is based on the computational assumption that the supersonic aerial projectile 62 is traveling parallel to the horizontal plane defined by the height of the transducers 12 and along the RIL 16 in route to the strafe target 10.

The first estimate of projectile velocity ($V_p$) 80 is the measured distance between the front transducer row 70 and the back transducer row 72 (derived from the static data 76) divided by the known TDOA of the acoustic shock wave at analogously positioned transducers in the front transducer row 70 and the back transducer row 72 (e.g., transducer T2 and transducer T6 depicted in FIG. 3B).

For example, assume that $T_2$ (in the front transducer row 70) has a TOA of 3.08 milliseconds (msec) and $T_6$ (in the back transducer row 72, disposed axially to $T_2$ and parallel to the RIL 16) has a TOA of 1.20 msec as measured by the signal processor 24. The measured distance between the denoted transducers (T2, T6) is 4.95 feet (the measured distance is derived from the static data 76). Thus, the first estimate of projectile velocity 80 is:

$$V_p=4.95 \text{ feet}/(3.08-1.20 \text{ msec})=2632.979 \text{ feet per second}$$

Finally, FIG. 4 depicts that the scoring algorithm process implemented by the uprange computer 32 is initialized by calculating the first estimate of mach angle 82 of the supersonic aerial projectile 62. Typically, a supersonic aerial projectile produces a shock wave that is conical in shape. This cone is the envelope of the spherical wavefronts produced by the supersonic aerial projectile 62 at any point in time with the projectile at the apex of the cone. The edges of the spherical wavefronts, which make up the cone surface, expand at the local speed of sound in air 78. Since the supersonic aerial projectile 62 is moving faster than the spherical wavefronts (e.g., faster than the local speed of sound in air 78), each successive spherical wavefront is produced in front of the previous (acoustic shock) wavefronts. The velocity of the supersonic aerial projectile 62 and the speed of the expanding wavefronts define the angle of the cone. As the projectile velocity increases, the shock wave angle will decrease. The first estimate of mach angle 82 (denoted by θ in the equation below) is one-half of the cone angle. The ratio $V_p/c$ is the Mach number.

The first estimate of mach angle (θ) 82 is calculated by the scoring algorithm process using the values of the local speed of sound in air (c) 78 and the first estimate of projectile velocity ($V_p$) 80 in the following equation:

$$\sin\theta=(c*t)/(V_{p*t});$$

$$\theta=\sin^{-1}(c/V_p),$$

(where t is any point in time and $c/V_p$ is the inverse of the Mach number)

Thus, using the values of c and $V_p$ described supra, the scoring algorithm process implemented by the uprange computer 32 calculates the first estimate of mach angle 82 as follows:

$$\theta=\sin^{-1}(c/V_p)=\sin^{-1}(1144.863 \text{ fps}/2632.979 \text{ fps})=25.7710°$$

Therefore, FIG. 4 illustrates that the scoring algorithm process implemented by the uprange computer 32 uses assumed data 74, static data 76 and data from the downrange computer 26 to initialize the scoring algorithm process, and that said initialization of the scoring algorithm process consists of computing the local speed of sound in air 78, the first estimate of projectile velocity 80 and computing the first estimate of mach angle 82.

Figure 5:
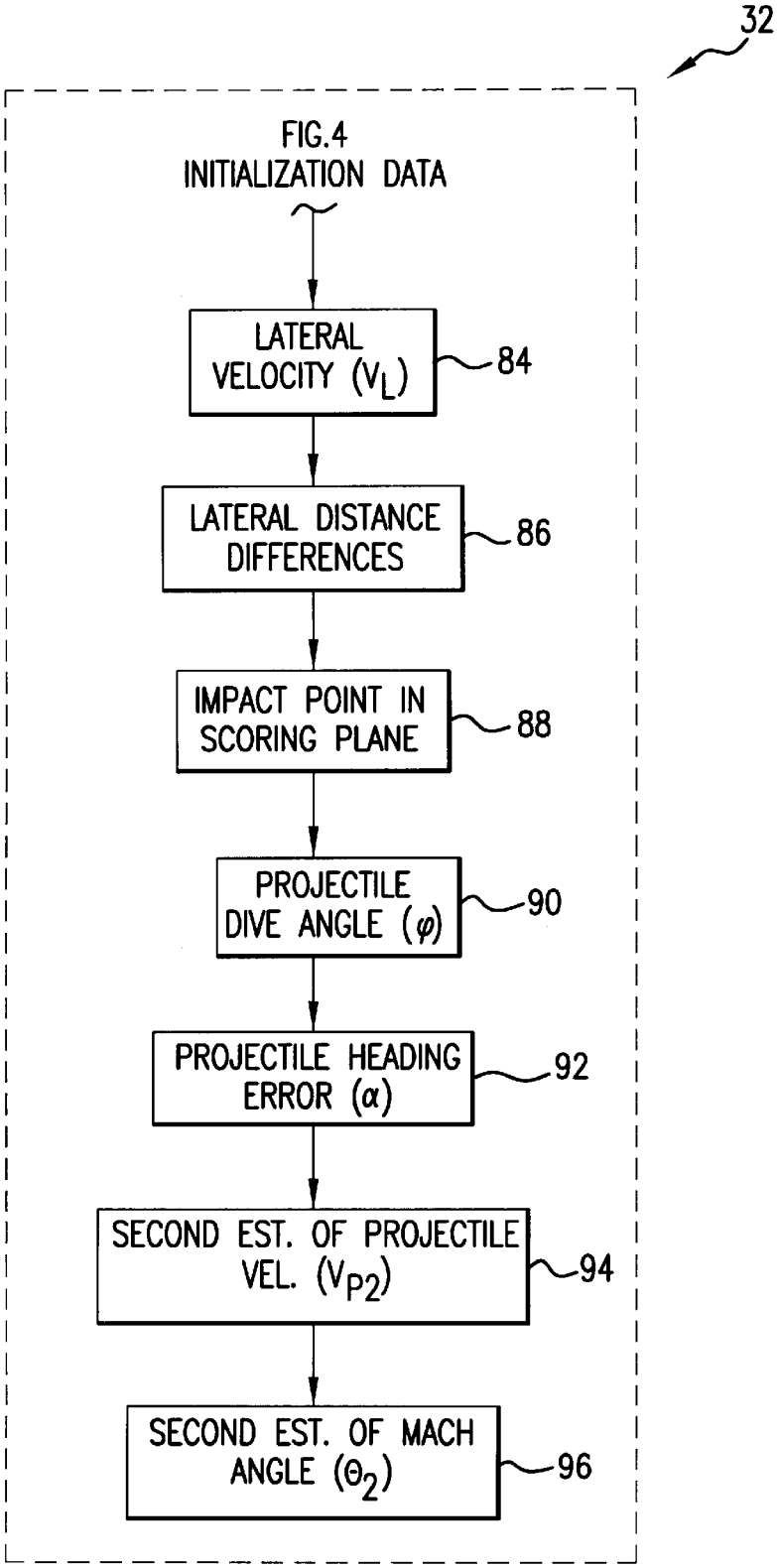
FIG. 5 is a schematic block diagram of the first iteration of the scoring algorithm process, in accordance with this invention.

FIG. 5 is a schematic block diagram illustrating how the uprange computer 32 implements the first iteration of the scoring algorithm process to calculate the estimated impact points of the supersonic aerial projectiles 62 on the strafe target 10, to calculate the heading error of the projectiles, and to calculate a second estimate of the velocities and a second estimate of the mach angles of the projectiles. The first iteration of the scoring algorithm process is implemented by calculating the lateral velocity 84 (denoted by $V_L$ in the equation below), which defines the lateral velocity of the acoustic shock wave of the supersonic aerial projectile 62 in the front scoring plane 71. For the first iteration of the scoring algorithm process, the lateral velocity 84 is assumed to be constant in the front scoring plane 71 based upon a predicate assumption that the flight path 66 of the supersonic aerial projectile 62 is parallel to the defined RIL 16.

For example, given the values of the local speed of sound in air (c) 78, the first estimate of projectile velocity ($V_p$) 80, and the first estimate of mach angle (θ) 82 calculated in the examples supra, the lateral velocity ($V_L$) 84 of the acoustic shock wave across the front scoring plane 71 is:

$$\tan\theta=(V_L{*}t)/(V_p{*}t)=V_L/V_p$$

or $$\cos\theta=(c{*}t)/(V_L{*}t)=c/V_L$$

$$V_L=V_p{*}\tan\theta=c/\cos\theta=1144.863\text{ fps}/\cos(25.771^\circ)=1271.314\text{ fps}$$

The scoring algorithm process uses the lateral velocity ($V_L$) 84 to initially determine distance differences of the supersonic aerial projectile 62 between transducer pairs in the front scoring plane 71. Referring to FIG. 3B for the purpose of mathematical illustration, three of the four transducers in the front transducer row 70 may nominally be labeled as transducers T1, T2, and T3, numbered consecutively left to right facing the strafe target 10. Similarly, three of the four transducers in the back transducer row 72 may be labeled T4, T5, and T6 in the same manner.

For example, assume that acoustic shock wave time-of-arrival (TOA) data is recorded by the signal processor 24, and that transducer $T_1$ has a TOA of 3.40 msec followed by 3.08, 6.96, 1.46, 1.20, and 5.03 msec, respectively for transducers T2 through T6. The scoring algorithm process calculates the projectile distance differences between transducer pairs in the scoring planes (e.g., the front scoring plane 71 for transducers T1, T2, and T3, and the back scoring plane 73 for transducers T4, T5, and T6) as follows:

$$D_{T1}-D_{T2}=V_L{*}(t_{T1}-t_{T2})=1271.314\text{ fps}{*}0.320\text{ msec}=+0.410\text{ feet}$$

$$D_{T2}-D_{T3}=V_L{*}(t_{T2}-t_{T3})=1271.314\text{ fps}{*}-3.880\text{ msec}=-4.930\text{ feet}$$

$$D_{T1}-D_{T3}=V_L{*}(t_{T1}-t_{T3})=1271.314\text{ fps}{*}-0.560\text{ msec}=-4.530\text{ feet}$$

$$D_{T4}-D_{T5}=V_L{*}(t_{T4}-t_{T5})=1271.314\text{ fps}{*}0.260\text{ msec}=+0.330\text{ feet}$$

$$D_{T5}-D_{T6}=V_L{*}(t_{T5}-t_{T6})=1271.314\text{ fps}{*}-3.830\text{ msec}=-4.970\text{ feet}$$

$$D_{T4}-D_{T6}=V_L{*}(t_{T4}-t_{T6})=1271.314\text{ fps}{*}-3.570\text{ msec}=-4.540\text{ feet}$$

Therefore, the uprange computer 32 implements the scoring algorithm process to calculate the lateral velocity 84, and the uprange computer 32 uses the lateral velocity 84, in conjunction with TOA data recorded by the signal processor 24, to further calculate the projectile distance differences between transducer pairs in the same scoring plane (e.g., the front scoring plane 71 for transducer pairs in the front transducer row 70 and the back scoring plane 73 for the transducer pairs disposed in the back transducer row 72).

Referring again to FIG. 5, the uprange computer 32 further implements the scoring algorithm process to calculate the impact point of the supersonic aerial projectile 62 on the front scoring plane 71. The acoustic shock wave from the supersonic aerial projectile 62 will propagate across the front scoring plane 71 as the projectile passes through the plane. The transducer closest to the flight path 66 of the projectile will trigger an analog electrical signal first, and a farther transducer will trigger a later analog electrical signal that directly correlates in time with its increased distance from the projectile flight path. The scoring algorithm process calculates the difference in signal TOA between the two transducers and uses this data and the lateral velocity 84 to determine the difference in distance the signal travels between the two transducers. Said calculation indicates that the supersonic aerial projectile 62 passes somewhere through a line on the front scoring plane 71 where the difference in distances between the two transducers from any point on the line is constant.

The constant-distance-difference line defines a hyperbola whose transverse axis is coincident with a lateral line formed between the two transducers (this is called the baseline). The hyperbola's foci points are the locations of the two transducers. The general equation of the base line is:

$$(x-h)^2/A^2-(y-k)^2/B^2=1$$

'A' is the distance from the center of the hyperbola to the point where the hyperbola intersects the baseline (defined as the x-axis of the front scoring plane 71); 'B' is the rise of the asymptote slopes which determines how much the line curves along with 'A'; 'h' is the horizontal offset of the center of the hyperbola from the origin of the scoring plane, and 'k' is the vertical offset of the center of the hyperbola from the origin of the front scoring plane 71.

The scoring algorithm process calculates the values of A and B using the equation above to determine the exact shape of the hyperbola. Parameter 'A' is calculated by determining the point along the base line where the known distance difference between the transducers exists (e.g., along the axis of the front transducer row 70, wherein the lateral spacing of the transducers 12 comprises part of the static data 76). The magnitude of 'A' is equal to one-half the difference in distance of the projectile to the transducers. The sign of 'A' can be positive or negative depending on which base line point on the hyperbola is being calculated.

For example, in an embodiment of the invention, the transducers 12 are laterally spaced at intervals of twenty feet within the front transducer row 70. Given a transducer spacing of twenty feet from each transducer to any point on the hyperbola:

$$(D_1-D_2=20\text{ feet}),$$

$$A=20/2=10\text{ feet}$$

$$A=\pm 10\text{ feet}$$

In addition to the difference in lateral distance between the transducers 12 in the front transducer row 70, the summation of the distances from the baseline point to the transducers is also known. This distance summation is equal to the known straight-line distance between any two of the transducers 12. For purposes of example, transducers T1 and T3 of FIG. 3B are used in the following examples. The difference and summation equations initially contain two unknown values, namely, the distances from the baseline point to each transducer. Solution of these two simultaneous linear equations will yield values for the transducer-to-baseline point distances. These distances are the closest points on the hyperbola to the transducers T1 and T3.

Therefore, if D1−D2=+20 feet, the baseline point, expressed in Cartesian coordinates, will be at (h+10, k). Since 'k' is always zero (the x-axis and transducer base line are coincident) and 'h' =0, the baseline point is located at (+10, 0). If D1−D2 =−20 feet, the baseline point will be located at (−10, 0). Moreover, the distances from either baseline point to each transducer will be equal to 40 feet, the distance between the transducers themselves ($D_{1,min}+D_{2,min}$=40 feet). This summation equation is valid only at the baseline point of the hyperbola; but the difference equation is valid at all points on the hyperbola.

Further, using a substitution methodology to simultaneously solve the equations yields that the closest distances from the hyperbola to the two transducers, which will occur at the baseline points, as follows:

(1) $D_1-D_2=-20$ feet $D_1=D_2-20$ feet (2) $D_{1,min}+D_{2,min}=+40$ feet

Substituting $D_1$ in equation (1) for $D1_{min}$ in equation (2) yields the following equation:

$$(D_{2,min}-20)+D_{2,min}=+40 \text{ feet}$$

$$2*D_{2,min}=40+20$$

$$D_{2,min}=60/2=30 \text{ feet}$$

$$D_{1,min}=D_{2,min}-20=30-20=10 \text{ feet.}$$

Accordingly, the baseline point on the hyperbola (point 1) is analytically determined to be located 10 feet from the T1 transducer and 30 feet from the T3 transducer.

To calculate 'B', the location of a second point (point 2) on the hyperbola is required since 'y' =0 for point 1 (e.g., no solution is possible for the value of 'B' because point 1 is on the base line). Point 2 is located using the intersection of two arcs, one centered at each transducer. The difference in arc lengths must be equal to the constant difference in distance between the two transducers, consistent with the mathematical definition of a hyperbola. The arcs will define two equations of circles with centers at the transducer locations and radii equal to the arc lengths. Solution of the roots of these two simultaneous equations gives two points of arc intersections, both of which are also points on the hyperbola, as illustrated in the following example:

The equation of a circle or arc is $(x-h)^2+(y-k)^2=r^2$, where (h, k) is the center of the circle and "r" is its radius. The center of circle 1 ('$C_1$') is (−20, 0); the center of circle 2 ('$C_2$') is (+20, 0). The length of the arc radii is as follows:

$$r_1=D_{1,min}+5=10+5=15 \text{ feet}$$

$$r_2=D_{2,min}+5=30+5=35 \text{ feet } (|r_1-r_2|=20 \text{ feet})$$

$$C_1\text{: } (x-(-20))^2+(y-0)^2=(15)^2\ x^2+40x+400+y^2=225$$

$$C_2\text{: } (x-20)^2+(y-0)^2=(35)^2\ x^2-40x+400+y^2=1225$$

$$C_1-C_2\text{:}80x=-1000\ x=-12.5 \text{ feet.}$$

Substituting "x" into C1, $$y^2=225-(-12.5+20)^2=168.75\ y=\pm 12.99 \text{ feet}$$

Point 2 is calculated as: (−12.5, ±12.99) feet

The scoring algorithm process uses point 2 of the hyperbola to solve for 'B,' thusly completing the equation of the hyperbolic line. The location and shape of the hyperbola is determined by where the supersonic aerial projectile 62 passes through the front scoring plane 71. A projectile passing in the middle of two of the transducers 12 of the front transducer row 70 will yield a straight line, and as the projectile passes closer to one transducer and farther from another transducer in the front transducer row 70, the hyperbolic line will increasingly curve. For example, if the Cartesian coordinates of Point 2 in the front scoring plane 71 are (−12.5, +12.99), the equation of the hyperbola centered at the origin is:

$$x^2/A^2-y^2/B^2=1, \text{ where } |A|=10 \text{ feet.}$$

$$(-12.5)^2/(10)^2-(12.99)^2/B^2=1\ B^2=299.98\ \text{''}B\text{''}=\pm 17.32 \text{ feet}$$

The equation of the hyperbola is analytically determined to be:

$$x^2/(10)^2-y^2/(17.32)^2=1$$

To determine the impact point on the front scoring plane 71, the scoring algorithm process uses TOA data from a third transducer in the front transducer row 70 to reduce the known hyperbolic equation to the actual point of impact on the front scoring plane 71. The time difference of said third transducer, relative to the other two transducers, will yield two additional unique hyperbolic lines using the computational process described supra. Both of these unique hyperbolic lines also pass through the actual point of impact of the supersonic aerial projectile 62 on the front scoring plane 71, but following different hypothetical paths. The additional lines will intersect at the actual impact point along with the original hyperbolic line. The three transducer pair combinations provide three simultaneous nonlinear equations with only two unknowns (x and y).

This produces three possible solutions of the intersection using different combinations of hyperbolic equations. Each solution of the intersection of two hyperbolas will yield four possible intersect points due to the two halves for each hyperbola; only one of the points is the correct impact point. Two of the points will be below the x-axis and are eliminated by the scoring algorithm process. The location of the remaining false point will depend on the location of the true point relative to the transducers. The actual impact point of the supersonic aerial projectile 62 on the front scoring plane 71 is determined by comparing results of the three solutions (only the true point will exist in all three solutions) or by taking into account the sign of the difference in distance between one transducer relative to its transducer pair (the sign will determine on which half of the hyperbolas the true point lies).

For example, and referring to FIG. 3B, assume the center transducer $T_2$ is placed at the defined origin and that transducer $T_1$ and transducer $T_3$ are located at +20 and −20 feet along the baseline, respectively. Knowing the difference in distance that a supersonic aerial projectile 62 passes between $T_2$ relative to $T_1$, and $T_2$ relative to $T_3$, will yield two additional equations of hyperbolas using the process described supra. Assuming a projectile passes through Point 2, designated as Cartesian coordinates (−22.5, +17.85) in the front scoring plane 71, and given the difference in distance between transducer $T_1$ to Point 2 and transducer $T_3$ to Point 2 ($D_1-D_3$), the equation of the hyperbola described supra will yield the hyperbolic line which passes through that point. The equation of said hyperbolic line is designated $H_{13}$ in the example below, and is labeled for the transducers used to derive it (e.g., T1 and T3).

Adding transducer $T_2$ and given the difference in distance from the supersonic aerial projectile impact point to transducer $T_1$ and transducer $T_2$, and to $T_2$ and $T_3$, yields two additional hyperbolic equations which will pass through the Point 2 independent of each other. The two additional equations are designated $H_{12}$ and $H_{23}$ in the example below. The centers of these two hyperbolas are not located at the origin, but rather at the midpoint of the transducer pair (e.g., −10 feet for $H_{12}$ and +10 feet for $H_{23}$.). Following the derivation outlined for transducer pair $T_1/T_3$ the following set of simultaneous equations of hyperbolic lines is obtained:

$$H_{12}: (x+10)^2/(1.51)^2-y^2/(9.88)^2=1 \text{ (given } D_1-D_2=-3.027 \text{ feet)}$$

$$H_{23}: (x-10)^2/(8.49)^2-y^2/(5.29)^2=1 \text{ (given } D_2-D_3=-16.973 \text{ feet)}$$

$$H_{13}: x^2/(10)^2-y^2/(17.32)^2=1 \text{ (given } D_1-D_3=-20 \text{ feet)}$$

Expanding equations $H_{12}$ and $H_{23}$:

$$H_{12}: (x^2+20x+100)/(2.2801)-y^2/(97.6144)=1$$

$$42.8115(x^2+20x+100)-y^2=97.6144$$

$$H_{23}: (x^2+20x+100)/(72.0801)-y^2/(27.9841)=1$$

$$(x^2-20x+100)/(2.5758)-y^2=27.9841$$

$$H_{12}-H_{23}: 42.4233x^2+863.9946x+4242.3271=69.6303$$

$$H_{12}-H_{23}: x^2+20.366x+98.3586=0$$

Solving this equation using the quadratic formula described supra yields:

$$H_{12}-H_{23}: x=[-20.366\pm(20.366^2-4*98.3586)^{0.5}]/2$$

$$x_1=-7.87 \text{ and } x_2=-12.50$$

Solving for 'y' using equation $H_{23}$ yields:

$$y^2=(x^2-20x+100)/(2.5758)-27.9841$$

$$y\pm[(x-10)^2/(2.5758)-27.9841]^{0.5}$$

Ignoring values of y<0: $y_1=9.80$ and $y_2=12.99$

The scoring algorithm process compares the results of the hyperbolic line equations to determine the true impact point of the supersonic aerial projectile 62 on the front scoring plane 71. For example, the two intersections of equations $H_{12}$ and $H_{23}$ occurring above the x-axis are (−7.87, 9.80) and (−12.50, 12.99) are both realistic scores. Comparing both points with the results of other hyperbolic line intersections reveals the true impact point on the front scoring plane 71. Repeating the process described supra, results in the following projectile location 2 and 3 results:

$$H_{12}-H_{13}: x_1=-18.03,\ y_1=25.92$$

$$x_2=-12.50,\ y_2=12.99$$

$$H_{23}-H_{13}: x_1=9.52,\ y_1=\text{imaginary (no intersection occurs)}$$

$$x_2=-12.50,\ y_2=12.99$$

The scoring algorithm process compares the results of the three solutions to determine that the supersonic aerial projectile 62 passes through the front scoring plane 71 at Cartesian coordinates (−12.50, 12.99).

The scoring algorithm process uses the hyperbolic equations, and the resultant computed impact point of the supersonic aerial projectile 62, independently for both the front scoring plane 71 and the back scoring plane 73. The computed points of impact for each scoring plane are used by the scoring algorithm process to solve third dimensions scoring supersonic aerial projectile data such as the projectile dive angle, the projectile heading error, and to update the first estimate of the projectile velocity 80 and the first estimate of the mach angle 82.

Referring again to FIG. 5, the uprange computer 32 implements the scoring algorithm process to calculate the projectile dive angle 90 and the projectile heading error angle 92 as described by the following example. Assume that the Cartesian coordinates of the impact points of the supersonic aerial projectile 62 are initially computed to be (−2.281, 0.821) feet on the front scoring plane 71 and (−2.335, 0.894) feet on the back scoring plane 73. Alternatively, these impact points, exemplified supra as Cartesian coordinates, may also be expressed in polar coordinate format. For example, the impact point on the front scoring plane 71 described above may alternatively be expressed as 2.424 feet @ 9:30 o'clock (−70.2° clockwise from top of plane). The projectile dive angle ($\phi$) 90 relative to the ground, and the projectile heading error ($\alpha$) 92 relative to the axis of the RIL 16 are computed by the scoring algorithm process as follows:

$$\phi=\sin^{-1}[(y_{1,back}+\Delta y_{1,2}-y_{1,front})/\Delta D_{L1,2}],$$

Where $\Delta y_{1,2}$ is the height difference of the back transducer row relative to the strafe target line and $\Delta D_{L1,2}$ is the horizontal distance between the front transducer row and the back transducer row. Assume that $\Delta y_{1,2}=0$ feet and $\Delta D_{L1,2}=4.94$ feet for purposes of this example. Thus:

$$\phi=\sin^{-1}[(0.894+0-0.821)/4.94]=0.844^{\circ}$$

$$\alpha=\tan^{-1}[(x_{1,\ tgt}-x_{1,front})/\Delta D_{L1,2}]$$

$$\alpha_2=\tan^{-1}[(-2.281--2.335)/4.94]=0.622^{\circ}$$

Finally, FIG. 5 shows that the uprange computer 32 implements the first iteration of the scoring algorithm process to calculate second estimates projectile velocity and second estimates of the mach angle. The following example discloses how the scoring algorithm process calculates the second estimate of the projectile velocity ($V_{p2}$) 94 and the second estimate of the mach angle ($\theta_2$) 96. Using the data described supra to illustrate calculation of the first estimate of projectile velocity 80 (e.g., T2: TOA=3.08 msec, T5: TOA=1.20 msec, $\Delta D_{T2,5}=4.95$ feet), and the data described supra to illustrate calculation of the projectile dive angle 90 (e.g., $\phi=0.844°$) and the projectile dive angle 92 (e.g., $\alpha=0.622°$), the initial computed impact points, the distances from the computed projectile impact point to the center transducers in each respective scoring plane are:

$$T_2: R_{tgt1}=(x_{tgt1}^2+y_{tgt1}^2)^{0.5}=(-2.281^2+0.821^2)^{0.5}=2.424 \text{ feet}$$

$$T_5: R_{front1}=(x_{front1}^2+y_{front1}^2)^{0.5}=(-2.335^2+0.894^2)^{0.5}=2.500 \text{ feet}$$

The times required for the acoustic shock wave to reach transducers $T_2$ and $T_5$ at the calculated distances computed above are:

$$T_2: t_{tgt1}=R_{tgt1}/V_{t1}=2.424 \text{ feet}/1271.314 \text{ fps}=1.907 \text{ msec}$$

$$T_5: t_{front1}=R_{front1}/V_{t1}=2.500 \text{ feet}/1271.314 \text{ fps}=1.966 \text{ msec}$$

The second estimated projectile velocity 94 is the distance the supersonic aerial projectile 62 travels from when the acoustic shock wave reaches transducer $T_5$ until the shock wave reaches transducer $T_2$ divided by the measured time difference between the transducer pair. The projectile travels '$t_{front}*V_p$' feet from the time the projectile reaches the back scoring plane 73 until the shock wave reaches transducer $T_5$. The projectile travels '$t_{tgt}*V_p$' feet from the time the projectile reaches the front scoring plane 71 until the shock wave reaches transducer $T_2$. The slant distance between the scoring planes is $\Delta D_{T2,5}*\cos\phi/\cos\alpha$. The total distance the projectile travels in the measured time ('$D_{proj}$') is the slant distance between scoring planes plus the distance the projectile travels in $t_{aft}$ seconds minus the distance the projectile travels in $t_{front}$ seconds. E.g.:

$$D_{proj}=\Delta D_{T2,5}*\cos\phi/\cos\alpha+t_{tgt}*V_p-t_{front}*V_p$$

$$V_{p2}=D_{proj}/(t_{T2}-t_{T5})$$

Since the calculation of '$D_{proj}$' is dependent on the first estimate of projectile velocity 80, and is used by the scoring algorithm process to calculate the second estimate of projectile velocity 94, the two equations above are combined so that the second estimate of projectile velocity 94 is not a function of the first estimate of projectile velocity 80. E.g.:

$$\begin{aligned} V_{p2} &= D_{proj}/(t_{T2}-t_{T5}) \\ &= (\Delta D_{T2,5}*\cos\varphi/\cos\alpha+t_{tgt}*V_p-t_{front}*V_p)/(t_{T2}-t_{T5}) \end{aligned}$$

$$\begin{aligned} t_{T2}-t_{T5} &= (\Delta D_{T2,5}*\cos\varphi)/(\cos\alpha*V_p)+t_{tgt}-t_{front}t_{T2}-t_{T5}-t_{tgt}+t_{front} \\ &= (\Delta D_{T2,5}*\cos\varphi)/(\cos\alpha*V_p) \end{aligned}$$

$$V_{p2} = \Delta D_{T2,5}*\cos\varphi/[\cos\alpha*(t_{T2}-t_{T5}-t_{tgt}+t_{front})]$$

$$\begin{aligned} V_{p2} &= \Delta D_{T2,5}*\cos\varphi_1/[\cos\alpha_1*(\{t_{T2}-t_{T5}\}-t_{tgt1}+t_{front1}) \\ &= 4.95\text{ feet}*\cos(0.844^\circ)/[\cos(0.622^\circ)* \\ &\quad (3.08-1.20-1.907+1.966\text{ msec}) \\ &= 2552.156\text{ fps (81.033 fps less (}-3.2\%) \\ &\quad \text{than the first estimate of projectile velocity described supra)} \end{aligned}$$

The scoring algorithm process uses the second estimate of projectile velocity 94 to calculate the second estimate of mach angle 96. E.g.:

$$\theta_2=\sin^{-1}(c/V_{p2})=\sin^{-1}(1144.863\text{ fps}/2552.156\text{ fps})=26.653^\circ$$
$$(0.882^\circ\text{ greater (+3.4\%) than the first estimate of mach angle described supra)}$$

Figure 6:
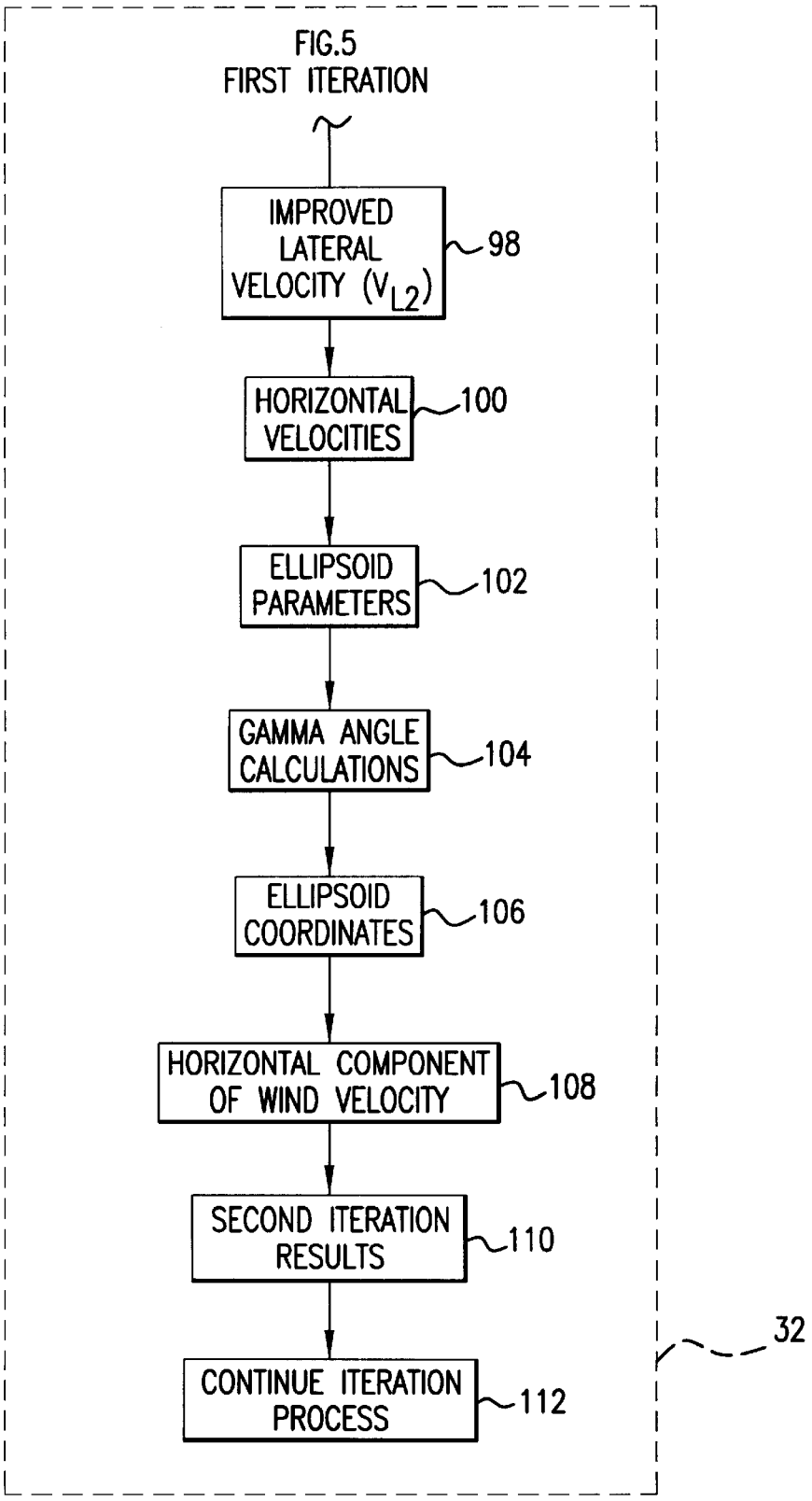
FIG. 6 is a schematic block diagram of the second iteration of the scoring algorithm process, in accordance with this invention.

FIG. 6 is a schematic block diagram illustrating how the uprange computer 32 implements the second iteration of the scoring algorithm process to improve the accuracy of the calculated impact points calculated by the first iteration process described supra. A first difference between the first and the second iterations of the scoring algorithm process is that the projectile heading error 92 is used in the second iteration process to calculate the effect of off-axis supersonic aerial projectiles 62, (e.g., where the flight paths 66 of said projectiles are not parallel to the flight axis defined by the RIL 16, thusly, "off-axis." Where the flight path 66 is off-axis, the propagation of the acoustic shock wave across the front and the back scoring planes will not be uniform—namely, the projectile lateral velocity 80 will not be uniform across the scoring planes. Therefore, the second iteration of the scoring algorithm process uses the projectile heading error angle 92 to calculate the lateral velocity of the acoustic shock wave towards each of the transducers 12, in the front scoring plane 71 and in the back scoring plane 73, instead of assuming a uniform lateral velocity.

A second difference between the first and second iterations of the scoring algorithm process is that weather data from the weather station 28 is used by the second iteration of the scoring algorithm process to improve scoring accuracy. The use of the weather data in the scoring algorithm process is described below.

The second iteration of the scoring algorithm process calculates an improved lateral velocity ($V_{L2}$) 98 by using the second estimate of the projectile velocity ($V_{p2}$) 94 and the second estimate of the mach angle ($\theta_2$) 96 described in the first iteration process supra. The improved lateral velocity 98 is only valid in the vertical direction (0° and 180° direction—normal to the ground) of the front scoring plane 71 and the back scoring plane 73, since said improved lateral velocity 98 does not take into account any projectile heading error 92. For example, using second estimate projectile velocity and mach angle data from the first iteration process described supra, the improved lateral velocity (($V_{L2}$) is:

$$V_{L2}=V_{p2}\tan\theta_2=2552.155\text{ fps}*\tan(26.653^\circ)=1280.981\text{ fps (thus, 9.66 fps greater (+0.7\%) than the projectile lateral velocity } (V_L)\text{ 84 described supra)}$$

The horizontal velocities 100 of the acoustic shock wave are calculated by the second iteration of the scoring algorithm process to determine a solution based upon a an equation of an ellipsoid corresponding to the lateral shock wave velocities in the front scoring plane 71 and the back scoring plane 73, respectively. The magnitude of the horizontal velocities 100 are calculated by using the law of sines and the first iteration values of the second estimate of projectile velocity 94, the second estimate of mach angle 96, and the projectile heading error 92. Thus, where:

$$V_{L,90}=V_p\sin\theta/\sin(90-\theta+\alpha)$$

$$V_{L,270}=V_p\sin\theta/\sin(90-\theta+\alpha)$$

And using the data calculated in the first iteration process described supra, it follows that:

$$\begin{aligned} V_{L,90} &= V_{p2}\sin\theta_2/\sin(90-\theta_2+\alpha) \\ &= 2552.156\text{ fps}*\sin(26.653^\circ)/\sin(90-26.653^\circ+0.622^\circ) \\ &= 1274.097\text{ fps} \end{aligned}$$

$$\begin{aligned} V_{L,270} &= V_{p2}\sin\theta_2/\sin(90-\theta_2-\alpha) \\ &= 2552.156\text{ fps}*\sin(26.653^\circ)/\sin(90-26.653^\circ-0.622^\circ) \\ &= 1288.093\text{ fps} \end{aligned}$$

In the example above, $V_{L,90}$ is less than $V_{L,270}$, which indicates that the supersonic aerial projectile 62 does not pass through the center of the mathematical ellipse defining the scoring plane, but rather is skewed to the side of the ellipse where the flight path 66 of the supersonic aerial projectile 62 angles away from the axis of the RIL 16 (e.g., the side where the projectile is "off-axis").

Referring further to FIG. 6, The scoring algorithm process calculates ellipsoid parameters 102 by using the general equation of an ellipse—$(x^2/a^2)+(y^2/b^2)=1$, where ±'a' are the x-intercepts along the major axis and ±'b' are the y-intercepts along the minor axis. The foci are located at ±'c' along the major axis, where the Pythagorean relationship $a^2=b^2+c^2$ holds true. Parameter 'a' is the average of the horizontal velocities ($V_{L,90}$ and $V_{L,270}$), as described supra. Parameter 'b' is equal to the improved lateral velocity 98, since the vertical velocity in the scoring plane is not affected by the projectile heading error 92.

For example, using the data supra, the ellipsoid parameters 102, consisting of parameters 'a' and 'b' (and 'c', derived from the Pythagorean relationship described above), are calculated as:

$$a=(V_{L,90}+V_{L,270})/2=(1274.097\text{ fps}+1288.093\text{ fps})/2=1281.095\text{ fps}$$

$$b=V_L=1280.981\text{ fps}$$

$$c=(a^2-b^2)^{1/2}=17.097\text{ fps}$$

Therefore the lateral velocity ellipsoid equation is:

$$x^2/(1281.095)^2+y^2/(1280.981)^2=1$$

The second iteration of the scoring algorithm solves for the gamma angle calculations 104, which are the angles from the supersonic aerial projectile 62 to the location of the transducers 12. The angles, (denoted by $\gamma_T$ in the equations below) may then be referenced to the shock wave ellipsoid to determine the actual velocity of the projectile toward each of the transducers 12. The actual velocity values will be different for each of the transducers 12 and will enable the scoring algorithm process to accurately convert the measured time differences to actual distance differences. The $\gamma_T$ angles are calculated by using the known projectile location (as described in the description of the first iteration process supra), the known transducer locations (from the static data 76 supra), and the trigonometric relationship between them. Thus, the equation for the gamma angle calculations ($\gamma_T$) 104 is:

$$'\gamma_T'=\tan^{-1}((X_{proj}-X_T)/(-Y_{proj}))$$

Further and as exemplified in the first iteration process described supra, the impact point of the projectile on the front scoring plane 71 was computed to be (−2.281, 0.821) feet and the initial back scoring plane 73 impact point was computed to be (−2.335, 0.894) feet. The transducers are located at −4.99; 0; +5.03 feet for transducers T1;T2;T3, respectively, and −5.02; 0; +4.98 feet for transducers T4;T5;T6, respectively. Thus:

$$\gamma_1=\tan^{-1}((X_{proj}-X_1)/(-Y_{proj}))=\tan^{-1}((-2.281-(-4.99))/(-0.821))=-73.15°$$

$$\gamma_2=\tan^{-1}((X_{proj}-X_2)/(-Y_{proj}))=\tan^{-1}((-2.281-0)/(-0.821))=+70.21°$$

$$\gamma_3=\tan^{-1}((X_{proj}-X_3)/(-Y_{proj}))=\tan^{-1}((-2.281-5.03)/(-0.821)=+83.59°$$

$$\gamma_4=\tan^{-1}((X_{proj}-X_4)/(-Y_{proj}))=\tan^{-1}((-2.335-(-5.02))/(-0.894))=-71.59°$$

$$\gamma_5=\tan^{-1}((X_{proj}-X_5)/(-Y_{proj}))=\tan^{-1}((-2.334-0)/(-0.894))=+69.05°$$

$$\gamma_6=\tan^{-1}((X_{proj}-X_6)/(-Y_{proj}))=\tan^{-1}((-2.335-4.98)/(-0.894))=+83.03°$$

The gamma angle calculations 104 in the example above are referenced to 0° being vertically downward with the counter-clockwise direction being positive. The angles from the projectile to the transducers 12 will therefore always fall between −90° to +90°, left to right.

In continued reference to FIG. 6, to calculate the ellipsoid coordinates 106, the scoring algorithm process calculates the point on the ellipse where an imaginary line between the projectile impact point and each transducer intersects the ellipse, This data is used to determined the actual velocity from the projectile to that point on the ellipse. The coordinates of the evaluated point are (Xγ, Yγ), which conforms to the general equation of the ellipse, described supra as $(X\gamma^2/a^2)+(Y\gamma^2/b^2)=1$. As also described supra, the impact point of the projectile is not located at the center of the ellipse. The actual impact point is $V_{L,270}$ fps from the left edge of the ellipse and $V_{L,90}$ from the right edge of the ellipse along the horizontal axis. Relative to the center (e.g., origin) of the ellipse, the projectile will be located $(V_{L,270}-V_{L,90})/2=a-V_{L90}$ fps from the origin along the major axis (vertical offset of the point will be 0). Thus, the projectile impact point is $(a-V_{L,90}, 0)$ fps from the ellipse origin. In this "velocity" domain, the angle from the projectile point to (Xγ, Yγ) on the ellipse is the same angle as from the projectile to the transducer as described supra. The scoring algorithm process uses this angle to solve a second equation containing the (Xγ, Yγ) coordinate terms, and further solves the two simultaneous equations for the two unknown terms. The second relationship equation is derived as follows:

$$\tan\gamma=(X\gamma-(a-V_{L,90}))/Y\gamma)$$

$$X\gamma=Y\gamma\tan\gamma+a-V_{L,90}$$

Substituting the value of Xγ into the general equation of the ellipse and solving for Yγ produce the following equation result:

$$Y\gamma=(-j-(j^2-4*l*k)^{1/2})/2i,$$

where $l=a^2+b^2*\tan^2\gamma$, $j=2*b^2*\tan\gamma*(a-V_{L,90})$, $k=b^2*(a-V_{L,90})^2-a^2*b^2$ Using the data from the examples above (data converted to feet/msec to avoid very large values in the calculations) (a=1281.095 fps=1.2811 feet/msec; b=1280.981 fps=1.2810 feet/msec; $V_{L,90}$=1274.097 fps=1.2741 feet/msec), the ellipsoid coordinates 106 are calculated as follows:

$$i_1=1.2811^2+1.2810^2*\tan^2(-73.15°)=19.5222\text{ ft}^2/\text{msec}^2$$

$$j_1=2*1.2810^2*\tan(-73.15°)*(1.2811-1.2741)=-0.0758\text{ ft}^2/\text{msec}^2$$

$$k_1=1.2810^2*(1.2811-1.2741)^2-1.2811^2*1.2810^2=-2.6930\text{ ft}^2/\text{msec}^2$$

$$Y\gamma_1=(0.0758-(0.0758^2-4*19.5222*-2.6930)^{1/2})/(2*19.5222)=-0.3695\text{ ft/msec}$$

Substituting the value into the equation $X\gamma=Y\gamma\tan\gamma+a-V_{L,90}$ yields:

$$X\gamma_1=-0.3695*\tan(-73.15°)+1.2811-1.2741=-1.2267\text{ ft/msec}$$

The calculations above are repeated by the scoring algorithm process for each of the transducers 12 and yield, for example, the following ellipsoid coordinates 106 for each of transducers T2 through T6:

| | |
|---|---|
| $Y_{Y_2}$ = −0.4360 feet/msec | $X_{Y_2}$ = 1.2046 feet/msec |
| $Y_{Y_3}$ = −0.1437 feet/msec | $X_{Y_3}$ = 1.2730 feet/msec |
| $Y_{Y_4}$ = −0.4024 feet/msec | $X_{Y_4}$ = −1.2162 feet/msec |
| $Y_{Y_5}$ = −0.4603 feet/msec | $X_{Y_5}$ = 1.1955 feet/msec |
| $Y_{Y_6}$ = −0.1562 feet/msec | $X_{Y_6}$ = 1.2715 feet/msec |

Further in accordance with FIG. 6, the second iteration of the scoring algorithm process computes the effect of the horizontal component of wind velocity 108, which is the vector component of the wind velocity parallel to the ground and the front and back scoring planes. The horizontal component of wind velocity 108 is added to the Xγ components of the projectile lateral velocities prior to combining with the Yγ components (which are assumed to be unaffected by wind) to determine actual lateral velocities.

The following example shows how the scoring algorithm process calculates the horizontal component of the wind velocity 108. The RIL 16 value is an element of the static data 76, as described supra. The wind velocity is a dynamic data parameter that is automatically provided to the uprange computer 32 via the weather station 28 and the downrange computer 26, as described supra. Thus, if the wind speed ($S_{wind}$) is 10 knots (16.88 fps), wind direction is (β) is 43° clockwise from magnetic North, and the RIL heading (δ) is 88° clockwise from magnetic North, the horizontal component of wind velocity 108 in the scoring planes is:

$$S_{wind,\ horiz}=S_{wind}*\cos(90°-\beta+\delta)=16.88\text{ fps}*\cos(90°-43°+88°)=-11.9360\text{ fps}$$

The negative sign of the solution in example above indicates that the wind is blowing the shock wave left (facing towards the strafe target 10 in the direction of the flight path 66) across the front and back scoring planes. The scoring algorithm process adds $S_{wind,\ horiz}$ to the Xγ values to compensate for the wind effects prior to combining with the Yγ values as described below.

Using the known values of shock wave velocities in the scoring plane along with $S_{wind,\ horiz}$, the second iteration of the scoring algorithm process calculates accurate lateral shock wave velocities for each of the transducers 12 using a modified solution of the Pythagorean Theorem described supra. Also as described supra, the supersonic aerial projectile 12 does not pass through the center of the ellipse, but is offset left or right depending on the projectile heading error 92 of the projectile. Since the Xγ and Yγ values are relative to the elliptical center, the Xγ value is adjusted so that the calculation is relative to the actual projectile impact point versus the elliptical center. Further as described supra, the projectile location will be horizontally offset from the elliptical center by $(V_{L,\ 270}-V_{L,\ 90})/2=a-V_{L,90}$ fps. This value is subtracted from Xγ, and $S_{wind,\ horiz}$ is added prior to applying Pythagorean's Theorem.

For example, in the examples described supra, the wind velocity was not measured but was assumed to be zero. The individual lateral velocities "$V_{L,\gamma}$" are computed by the scoring algorithm process using the following formula (as applied to transducer T1):

$$V_{L,\gamma}=((X\gamma-a+V_{L,90}+S_{wind,\ horiz})^2+Y\gamma^2)^{1/2}$$

$$V_{L,\gamma 1}=1000*((-1.2267\text{ feet/msec}-1.2811+1.2741+0)^2+(-0.3695)^2)^{1/2}=1287.79\text{ fps}$$

Applying the same formula to transducers T2 through T6 yields:

$V_{L,\ \gamma 2}$=1274.50 fps $V_{L,\ \gamma 3}$=1274.14 fps $V_{L,\ \gamma 4}$=1287.73 fps $V_{L,\ \gamma 5}$=1274.55 fps $V_{L,\ \gamma 6}$=1274.15 fps The individual lateral velocities in the example above are close to the improved lateral velocity 98 value calculated supra ($V_{L2}$=1280.981 fps). This is because the projectile heading error 92 is small in the examples and there are no wind effects factored into the examples.

The scoring algorithm process uses the $V_{L,\gamma}$ values described above in place of a single constant value for conversion of the TOA's to accurate distance differences. By using the individual values of $V_{L,\gamma}$, more accurate distance differences of the supersonic aerial projectile 62 between transducer pairs in the respective scoring plane are calculated. For example, using the data described supra in the discussion of the first iteration process, (e.g., transducer T1 TOA is 3.40 msec followed by 3.08, 6.96, 1.46, 1.20, and 5.03 msec for transducers T2 through T6, respectively), the distance differences ($D_{Tx}$) are:

$D_{T1}-D_{T2}=(V_{L,\ \gamma 1}*t_{T1})-(V_{L,\ \gamma 2}*t_{T2})$=1287.79 fps*3.40 msec−1274.50 fps*3.08 msec=0.45 feet (versus 0.41 feet in the example described supra for the first iteration process)

Using the same formula for the remaining transducer pairs, the second iteration of the scoring algorithm process yields:

$D_{T2}-D_{T3}$ =−4.94 feet (versus −4.930 feet for the first iteration process supra)

$D_{T1}-D_{T3}$ =−4.49 feet (versus −4.530 feet for the first iteration process supra)

$D_{T4}-D_{T5}$ =0.35 feet (versus 0.33 feet for the first iteration process supra)

$D_{T5}-D_{T6}$ =−4.88 feet (versus −4.87 feet for the first iteration process supra)

$D_{T4}-D_{T6}$ =−4.53 feet (versus −4.54 feet) for the first iteration process supra)

Further in accordance with FIG. 6, the scoring algorithm process solves for the second iteration results 110 by using the same process described supra for the first iteration process. Thus, starting with calculating hyperbolic line equations for each transducer pair, the line equations are determined. The lines are then intersected to determine the supersonic aerial projectile 62 impact in the front scoring plane 71 and the back scoring plane 73. The scoring algorithm process uses the updated coordinates to recalculate the projectile vector angles, projectile velocity, and mach angle. When the projectile velocity 94 is updated by the second iteration process, the lateral velocities for each transducer (as described supra) are used in place of the improved lateral velocity 98 (e.g., use $V_{L,\gamma 2}$ for the front scoring plane 71 and $V_{L,\gamma 5}$ for the back scoring plane 73).

Therefore, using the data in the examples described supra, the second iteration of the scoring algorithm process calculates the second iteration results 110 as follows:

Back Scoring Plane Projectile Impact Point: $x_2$=−2.3250, $y_2$=0.8465 (difference of (0.01, −0.05) from the first iteration process supra)

Front Scoring Plane Projectile Impact Point: $x_2$=−2.2579, $y_2$=0.7712 (difference of (0.02, −0.05) from the first iteration process supra)

Projectile Dive Angle: $\phi_2$=0.8740° (difference of 0.0274° from the first iteration process supra)

Projectile Heading Error: $\alpha_2$=0.7788° (difference of 0.1552° from the first iteration process supra)

Projectile Velocity: $V_{p3}$=2539.59 (difference of −12.57 fps from the first iteration process supra)

Mach Angle: $\theta_3$=26.7954° (difference of 0.1424° from the first iteration process supra)

Finally in reference to FIG. 6, once the second iteration calculations are completed (e.g., as described in the example above), the scoring algorithm process continues the iteration process 112. The third iteration of the algorithm scoring process (iteration 3), and each successive iteration, uses the same process as described supra for the second iteration.

This iteration process is repeated by the uprange computer 32 until the new parameter values are as near the previous calculated parameters as desired which indicates that the true scoring value lie somewhere near the current computed value ± the difference between the new solution and the previous solution. This difference is referred to as the delta (Δ). The defined value that the delta magnitude must be less than to insure the desired accuracy is referred to as the epsilon (ϵ) value. The epsilon values are embedded in the software (namely, they are pre-programmed into the uprange computer 32 prior to implementation of the scoring algorithm process). Thus, for example, the following epsilon values may be selected for the calculated variables to achieve a high degree of scoring accuracy:

$V_p$, $V_L$: $\epsilon$=0.1 fps $\theta$, $\phi$: $\epsilon$=0.01°

(x, y): $\epsilon$=(0.01, 0.01) feet

FIG. 7 is a table showing the calculated scoring data for the examples of the first and the second iteration processes described supra, and further showing how the scoring data is iteratively computed by the scoring algorithm process until the delta values are less than the defined epsilon values for all variables. In FIG. 7, the dive angle $\phi$ and impact coordinates reach this threshold at the third iteration of the scoring process. The remaining variable delta values fall below their respective epsilon values in the fifth through eighth iterations of the scoring process. Thus, FIG. 7 further illustrates that the scoring algorithm process can, by iteration, compute scoring data to any degree of accuracy desired by the operator. The described $\epsilon$ values illustrate that the scoring solution will converge to the actual values as the uprange computer 32 repeatedly implements the iteration process. In a military embodiment of the invention, the iteration process will typically produce sufficiently accurate scoring data after the third or fourth iterations of the scoring algorithm process.

Figure 8:
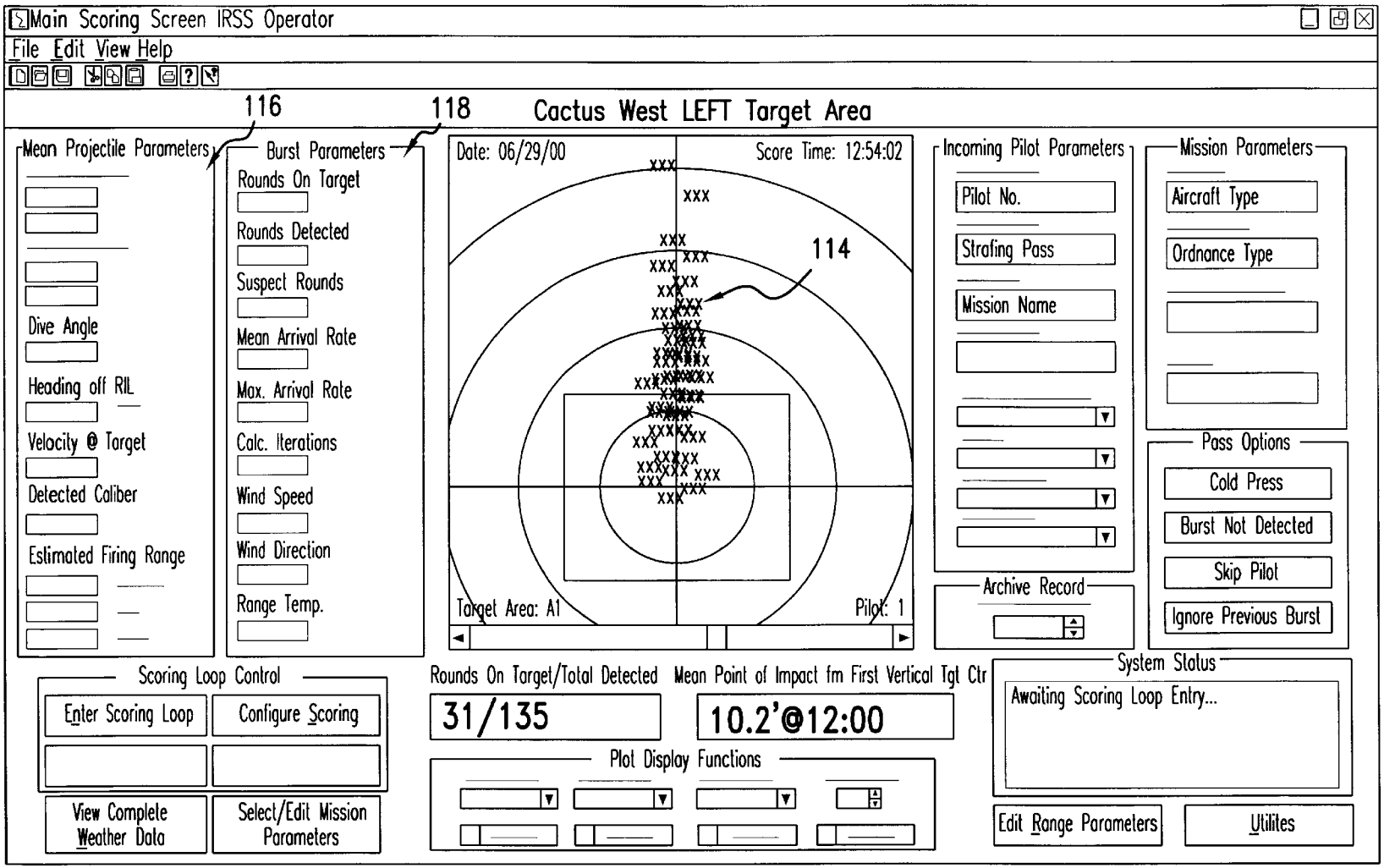
FIG. 8 is a typical display of supersonic aerial projectile scoring data and target data indicated to the operator, in accordance with this invention.

FIG. 8 illustrates an embodiment of how the invention indicates scoring data to the operator, here on the display 56. As described supra, the uprange computer 32, by implementing the scoring algorithm process, calculates the impact points of the supersonic aerial projectiles 62 upon the front scoring plane 71, and graphically overlays said computed impact points on a representative silhouette of the strafe target 10. As depicted in FIG. 8, the rectangular part of Target Area A1 represents the silhouette of the strafe target 10, and the impact points of the projectiles upon the front scoring plane 71 are represented by numbered points 114 disposed in and about the rectangular part of Target Area A1. Each of the numbered points 114 corresponds to an individual supersonic aerial projectile 62 impact point upon the front scoring plane 71. By comparing the impact points to the silhouette, a visual indication of scoring data is presented to the operator.

The uprange computer 32 also computes: the number of rounds (supersonic aerial projectiles) on-target (e.g., computed to fall within the silhouette of the strafe target 10) (e.g., 31 round on-target in FIG. 8); the total number of projectiles detected (e.g., 135 total detected in FIG. 8) and the mean point of impact (in polar coordinates relative to the geometric center of the strafe target 10 on the display 56) (e.g., 10.2' @ 12:00 mean point of impact in FIG. 8), and indicates such scoring data to the operator.

FIG. 8 further illustrates how other useful scoring data may be indicated to the operator. For example, the mean projectile parameters 116, comprising the dive angle (described supra as the projectile dive angle 90), heading off RIL (described supra as the projectile heading error 92), velocity at target (described supra in FIG. 7 as the final iterative calculation of projectile velocity 94), detected caliber, and the estimated firing range (of the strafe aircraft 9) are indicated to the operator. Similarly, the burst parameters 118, comprising the number of rounds (supersonic aerial projectiles) detected by an embodiment of the apparatus of the invention, mean arrival rate (number of projectiles per minute impacting the scoring planes), maximum arrival rate, the number of calculated iterations of the scoring algorithm process, the wind speed and direction (transmitted to the uprange computer 32 from weather station 28), the range temperature (also from the weather station 28) and suspect rounds are indicated to the operator.

Suspect rounds typically occur when the TOA data set (e.g., signals received by the signal processor 24 from the transducers 12) is corrupt. For example, if a TOA data set contains acoustic shock wave TOA's from two or more supersonic aerial projectiles 62 and assumes that such shock waves are from a single projectile, the scoring solution will typically not converge to within the epsilon values. One typical way the data set can be corrupted is when supersonic aerial projectiles do not impact upon the strafe target 10, but instead impact between the front and back transducer rows. In such a case, the front transducer row 70 detects the acoustic shock waves, but the back transducer row 72 does not. The scoring algorithm process has a series of steps to validate the data sets so that errors in the data set does not affect all subsequently detected supersonic aerial projectiles. Thusly, if a projectile data set does not converge to the epsilon values within 25 iterations, the scoring algorithm process for that data set is stopped and the data is indicated by the uprange computer 32 to the operator as suspect and not included in the scoring data.

Finally, FIG. 8 shows that a variety of other data is presented to the operator, and that the operator may enter data into the uprange computer to properly record the particulars of the scoring process. For example, the operator may enter static data 76 concerning the mission parameters, such as the type of strafe aircraft 9 and the type of supersonic aerial projectile (ordnance) employed. Incoming pilot parameters such as the pilot number, the strafing pass number and the mission name may also be entered by the operator. Although, FIG. 8 illustrates indication of scoring data to the operator on the display 56, scoring data may be selectably indicated to the operator on the printer 34 or annunciated via the RASA 36. Alternatively, scoring data may be stored in the memory (e.g., in the main memory 50, ROM 52, or the storage device 54) of the uprange computer 32 for later use in scoring analysis and re-scoring as desired by the operator.

There accordingly has been described a time-difference process and apparatus for scoring supersonic aerial projectiles directed at a strafe target by automatically detecting and measuring the time-differences of the arrival of the acoustic shock waves of the supersonic aerial projectiles at an array of transducers of the apparatus. A computer, coupled to and configured to receive processed signals from the transducers and weather data from a weather station of the apparatus, automatically implements a scoring algorithm process to calculate the impact points of the supersonic aerial projectiles upon the strafe target. The impact points of the supersonic aerial projectiles 62 on the strafe target 10, and other useful scoring data, are indicated to the operator by a display, printer or by annunciation on a RASA. Accordingly, by the process and apparatus of an embodiment of the invention an operator may rapidly and accurately be informed of scoring data for supersonic aerial projectiles directed at a strafe target.

The reader's attention is directed to all papers and documents which are filed concurrently with this disclosure and which are open to public inspection with this specification, and the contents of all such papers and documents are incorporated herein by reference. All the features described in this disclosure (including the accompanying claims, abstract and drawings) may be replaced by alternative features serving the same, equivalent or similar purpose unless expressly stated otherwise. Thus, unless expressly stated otherwise, each feature disclosed is but an example of a generic species of equivalent or similar features. Moreover, any element in a claim that does not explicitly state "means for" performing a specified function or "step for" performing a specific function is not be interpreted as a "means" or "step" clause as specified by 35 U.S.C. 112 ¶ 6. In particular, any use of "step of," "act of" or "acts of" in the claims below is not intended to invoke the provisions of 35 U.S.C. 112 ¶ 6.

In this disclosure, there is shown and described only the preferred embodiment of the invention, but as, aforementioned, it is to be understood that the invention is capable of use in various other combinations and environments and is capable of changes or modifications within the scope of the inventive concept expressed herein.

What is claimed is:

1. A computer-based apparatus for scoring supersonic aerial projectiles by measuring the acoustic shock waves propagated by the projectiles, the apparatus comprising:

i) an array of at least six transducers disposed proximate to a strafe target, said transducers being independently operable to transmit analog signals in response to receiving acoustic shock waves propagated by supersonic aerial projectiles directed at the strafe target;

ii) a multichannel signal processor coupled to said transducers for receiving the analog signals and converting such signals to equivalent digital signals;

iii) at least one general-purpose digital computer coupled to said signal processor and operable to receive the digital signals from said signal processor;

iv) computing means implemented by said computer for computing scoring data for the supersonic aerial projectiles by iteratively measuring the digital signals; and v) processing means implemented by said computer for indicating said scoring data.

2. The apparatus for scoring supersonic aerial projectiles of claim 1, wherein said computing means are operable to iteratively compute said scoring data by measuring the time differences of arrival of the acoustic shock waves at said transducers, said computing means being further operable to iteratively compare said scorn data to target data from the strafe target.

3. The apparatus for scoring supersonic aerial projectiles of claim 2, wherein said computing means includes a second general-purpose digital computer coupled to said computer and remotely operable to receive the digital signals from said computer to compute said scoring data.

4. The apparatus for scoring supersonic aerial projectiles of claim 3, wherein said array of transducers consists of an array of eight independently operable transducers for increasing the accuracy of said scoring data computed by said second-purpose digital computer.

5. The apparatus for scoring supersonic aerial projectiles of claim 4, wherein said multichannel signal processor is operable to automatically sample and record in response to receiving the analog signals from said transducers, said multichannel sign processor being further operable to sample the analog signals at a minimum of one hundred kilocycles per channel.

6. The apparatus for scoring supersonic aerial projectiles of claim 4, further comprising a weather station coupled to said computer, said weather station being operable to automatically transmit ambient atmospheric temperature data, wind velocity data and barometric pressure data to said second general-purpose digital computer for use in computing said scoring data.

7. The apparatus for scoring supersonic aerial projectiles of claim 4, wherein said processing means includes a display and printer coupled to sa d second general-purpose digital computer for selectably indicating said scoring data and the target data to an operator.

8. A computer-based process for scoring supersonic aerial projectiles by measuring the acoustic shock waves propagated by the aerial projectiles the process comprising:

i) receiving by at least six independently operable transducers the acoustic shock waves propagated by supersonic aerial projectiles directed at a strafe target;

vi) transmitting signals generated by said transducers in response to the acoustic shock waves to at least one general-purpose digital computer;

vii) iteratively computing by use of said computer scoring data for the supersonic aerial projectiles;

viii) iteratively comparing by use of said computer said scoring data with target data from the strafe target; and ix) processing by use of said computer said scoring data and the target data.

9. The process for scoring supersonic aerial projectiles o claim 8, wherein the act of receiving consists of an array of eight transducers independently operable to transmit the signals in response to the acoustic shock waves propagated by the supersonic aerial projectiles.

10. The process for scoring supersonic aerial projectiles of claim 9, wherein the act of computing consists of measuring by said computer the time differences of arrival of the acoustic shock waves at said transducers to calculate said scoring data.

11. The process of scoring supersonic aerial projectiles of claim 10, wherein the act of computing further comprises a second general-purpose digital computer remotely operable to receive the signals from said computer for computing said scoring data.

12. The process for scoring supersonic aerial projectiles of claim 11, wherein the act of transmitting the signals from said transducers to said computer includes a multichannel signal processor for converting the signals from analog to digital signal format.

13. The process for scoring supersonic aerial projectiles of claim 11, wherein the act of processing includes a display and a printer coupled to said second general-purpose digital computer for selectably indicating said scoring data and the target data to the operator.

14. A computer-based system for scoring supersonic aerial projectiles by measuring the acoustic shock waves propagated by the aerial projectiles, the system comprising:

i) receiving means for detecting the acoustic shock waves propagated by supersonic aerial projectiles directed at a strafe target, wherein said receiving means comprises an array of at least six transducers disposed proximate to the strafe target and independent operable to transmit signals in response to the acoustic shock waves;

iv) transmitting means for transmitting signals generated in response to the acoustic shock waves, the signals being transmitted to at least one general-purpose digital computer;

iv) computing means implemented by said computer for computing scoring data for the supersonic aerial projectiles and for comparing said scoring data with target data from the strafe target; and iv) processing means for indicating said scoring data and the target data.

15. The system for scoring supersonic aerial projectiles of claim 14, wherein said array of transducers consists of an array of eight transducers disposed proximate to the strafe target and independently operable to transmit signals in response to the acoustic shock waves.

16. The system for scoring supersonic aerial projectiles of claim 15, wherein said computing means further comprises a second general-purpose digital computer remotely operable to receive the signals from said computer for computing said scoring data.

17. The system for scoring supersonic aerial projectiles of claim 16 wherein said transmitting means includes a multichannel signal processor coupled to said transducers for receiving the analog signals and converting such signals to equivalent digit signals.

18. The system for scoring supersonic aerial projectiles of claim 17, wherein said computing means includes automatically measuring and using ambient atmospheric temperature data and wind velocity data for computing said scoring data.

* * * * *